US011533948B2

(12) United States Patent
Goradesky

(10) Patent No.: US 11,533,948 B2
(45) Date of Patent: Dec. 27, 2022

(54) LOADER FUNNEL

(71) Applicant: Harold Scot Goradesky, Plantation, FL (US)

(72) Inventor: Harold Scot Goradesky, Plantation, FL (US)

(73) Assignee: Buddy Box LLC., Weston, FL (US)

( * ) Notice: Subject to any disclaimer, the term of this patent is extended or adjusted under 35 U.S.C. 154(b) by 37 days.

(21) Appl. No.: 16/825,101

(22) Filed: Mar. 20, 2020

(65) Prior Publication Data

US 2020/0214340 A1 Jul. 9, 2020

Related U.S. Application Data

(63) Continuation-in-part of application No. 16/291,902, filed on Mar. 4, 2019, now Pat. No. 10,966,454, (Continued)

(51) Int. Cl.
*A24F 13/10* (2006.01)
*A24F 1/28* (2006.01)
(Continued)

(52) U.S. Cl.
CPC ..... *A24F 13/10* (2013.01); *A24F 1/26* (2013.01); *A24F 1/28* (2013.01); *A24F 13/12* (2013.01); *A24F 13/22* (2013.01); *A24F 23/04* (2013.01)

(58) Field of Classification Search
CPC .. A24F 13/10; A24F 1/28; A24F 13/22; A24F 23/04; A24F 13/12; A24F 1/26
See application file for complete search history.

(56) References Cited

U.S. PATENT DOCUMENTS 1,186,148 A * 6/1916 Tenney ..... B67D 7/3209 141/86
4,211,244 A 7/1980 Williams
(Continued)

*Primary Examiner* — Michael Collins
(74) *Attorney, Agent, or Firm* — Christopher & Weisberg, P.A.

(57) ABSTRACT

The present invention advantageously provides a device and system for packaging, storing, and smoking an organic smoking material, and a method of using same. In one exemplary embodiment, the system includes a loading device configured to receive organic smoking material and facilitate the depositing of the smoking material into a container. The container includes a first end defining an opening sized to receive the organic smoking material, an opposite second end, and a lateral surface extending therebetween. The loading device comprises a loading funnel sized and configured to engage at least a portion of the opening of the container and a first arm extending from the loading funnel and configured to be adjacent to the lateral surface when the loading funnel engages the opening. The first arm includes a proximal end connected to the loading funnel and an opposite distal end. Additionally, the first arm includes a first surface and an outer second surface. Further, the loading device includes a second arm which extends from the first arm and is configured to releasably engage the second end of the container when the first arm is adjacent to the lateral surface. The second arm further includes a proximal end connected to the distal end of the first arm and an opposite distal end. The second arm may also include a first surface and an outer second surface.

3 Claims, 18 Drawing Sheets

Related U.S. Application Data which is a continuation of application No. 16/130,609, filed on Sep. 13, 2018, now Pat. No. 10,258,081.

(60) Provisional application No. 62/693,639, filed on Jul. 3, 2018.

(51) Int. Cl.

| | |
|---|---|
| ***A24F 1/26*** | (2006.01) |
| ***A24F 23/04*** | (2006.01) |
| ***A24F 13/12*** | (2006.01) |
| ***A24F 13/22*** | (2006.01) |

(56) References Cited

U.S. PATENT DOCUMENTS

| | | | | | |
|---|---|---|---|---|---|
| 4,214,658 | A | | 7/1980 | Crow | |
| 4,294,267 | A | | 10/1981 | Glymph | |
| 4,589,427 | A | | 5/1986 | Barnes | |
| 4,993,675 | A | * | 2/1991 | Walker | A47G 23/0266 220/759 |
| 5,143,335 | A | * | 9/1992 | Frankel | B62B 9/00 211/74 |
| 5,456,046 | A | * | 10/1995 | Vitalune | A01G 5/04 248/214 |
| 5,564,442 | A | | 10/1996 | MacDonald | |
| 5,848,596 | A | | 12/1998 | Zelenik | |
| 5,967,310 | A | | 10/1999 | Hill | |
| 5,967,312 | A | | 10/1999 | Jacobs | |
| 6,045,097 | A | * | 4/2000 | Gaffar | A61J 1/16 211/85.15 |
| 6,474,342 | B1 | | 11/2002 | Rennecamp | |
| 7,395,842 | B2 | * | 7/2008 | Dyer | B65B 67/12 211/85.15 |
| 7,603,726 | B2 | * | 10/2009 | Sawalski | B65D 83/20 4/223 |
| 7,717,259 | B2 | | 5/2010 | Hatton | |
| 7,802,763 | B2 | * | 9/2010 | Faller | A47J 47/01 141/10 |
| 8,726,949 | B1 | * | 5/2014 | Poire | B67C 11/02 141/338 |
| 8,763,835 | B2 | * | 7/2014 | Tirone | A23G 9/28 426/115 |
| D812,989 | S | * | 3/2018 | Seiders | D7/622 |
| 10,258,080 | B2 | | 4/2019 | Barrett | |
| 10,258,081 | B1 | * | 4/2019 | Goradesky | A24F 13/22 |
| 10,370,837 | B2 | * | 8/2019 | Wood | A47K 17/00 |
| 10,426,193 | B2 | | 10/2019 | Schennum et al. | |
| 10,966,454 | B2 | * | 4/2021 | Goradesky | A24F 1/28 |
| D925,823 | S | * | 7/2021 | Goradesky | D27/194 |
| 2002/0007866 | A1 | * | 1/2002 | Swan | B67D 3/0029 141/331 |
| 2011/0011488 | A1 | * | 1/2011 | Sickler | B67C 11/02 141/1 |
| 2017/0035105 | A1 | | 2/2017 | Jordan | |
| 2018/0334788 | A1 | * | 11/2018 | Wood | E03D 9/005 |
| 2022/0071274 | A1 | * | 3/2022 | King | A24C 5/02 |

* cited by examiner

LOADER FUNNEL

CROSS-REFERENCE TO RELATED APPLICATIONS

This application is a Continuation-in-Part of U.S. patent application Ser. No. 16/291,902, filed on Mar. 4, 2019, entitled ORGANIC SMOKING MATERIAL DISPENSER, which is related to and claims priority to U.S. patent application Ser. No. 16/130,609, filed on Sep. 13, 2018, entitled ORGANIC SMOKING MATERIAL DISPENSER, which claims priority to U.S.

Provisional Patent Application Ser. No. 62/693,639, filed Jul. 3, 2018, entitled ORGANIC SMOKING MATERIAL CONTAINER, the entireties of all of which are incorporated herein by reference.

TECHNICAL FIELD

This disclosure relates to a device and system for packaging and smoking an organic smoking material, and a method of using same.

BACKGROUND

Organic smoking materials, such as tobacco and herbal mixtures, are sold over the counter either in bulk or loose form (for example, packaged loosely in a bag) or assembled (for example, as a rolled cigarette). Similarly, marijuana, such as medical marijuana, is also typically sold by dispensaries in bulk, or as intact buds. For example, a sealable bag is typically used as a container for an organic smoking material packaged in its loose form.

A buyer must purchase the organic smoking material in its loose form if the buyer prefers to prepare or assemble the smokable product himself, such as rolling a cigarette or packing a pipe. However, currently known packaging or containers do not provide a means by which the buyer can prepare the smokable product. For example, marijuana sold by dispensaries typically is packaged in a sealable bag or container, since such packaging is disposable and cost effective. However, this packaging is only for containing the marijuana and does not provide any other utility. Although there are a variety of available tools for preparing and smoking an organic smoking material, these must be purchased separately and can be expensive. Additionally, even currently known multi-use tools have disadvantages.

Non-disposable containers may also be used for containing organic smoking material. An exemplary currently known container may be composed of wood or other material, and includes a first compartment for storing a removable pipe or smoking device and a second compartment for storing a quantity of organic smoking material. The container also includes a lid that covers the first and second compartments. In one example, the lid is rotatable between open and closed positions. However, the lid merely functions to contain the organic smoking material and smoking device, and does not provide an airtight seal. Consequently, a humidity level within the second compartment cannot be maintained and odors are allowed to escape, not only alerting others to the contents of the container, but also allowing the organic smoking material to dry out. Additionally, in many cases the organic smoking material must be chopped or torn into smaller pieces in order to fit within the second compartment, which may be very small. This may affect the quality of the organic smoking material. Another disadvantage is that it can be very difficult to insert the organic smoking material into the second compartment without mess. Further, this container does not facilitate the easy removal and assembly of the organic smoking material into the smoking device. For example, the organic smoking material must be dumped out of the container, a small quantity used to load the smoking device 16, and the remainder reinserted into the container. Finally, this container is not intended to be disposable. As a result, the container may be constructed from expensive materials, such as wood, glass, or dense plastic.

Existing loading funnels are used to deposit organic smoking material into a container and/or smoking device. However, these funnels require users to contemporaneously hold the loading funnel over the container and/or smoking device during the loading process, and do not provide an associated device to facilitate the entry of the organic smoking material into the container and/or smoking device without mess. Furthermore, existing loading funnels are not easily transportable owing to the number of associated pieces required for use of the device.

SUMMARY

The present invention advantageously provides a device and system for packaging, storing, and smoking an organic smoking material, and a method of using same. In one exemplary embodiment, the system includes a loading device configured to receive organic smoking material and facilitate the depositing of the smoking material into a container. The container includes a first end defining an opening sized to receive the organic smoking material, an opposite second end, and a lateral surface extending therebetween. The loading device comprises a loading funnel sized and configured to engage at least a portion of the opening of the container and a first arm extending from the loading funnel and configured to be adjacent to the lateral surface when the loading funnel engages the opening. The first arm includes a proximal end connected to the loading funnel and an opposite distal end. Additionally, the first arm includes a first surface and an outer second surface. Further, the loading device includes a second arm which extends from the first arm and is configured to releasably engage the second end of the container when the first arm is adjacent to the lateral surface. The second arm further includes a proximal end connected to the distal end of the first arm and an opposite distal end. The second arm may also include a first surface and an outer second surface.

In another aspect of the embodiment, the second arm is orthogonal to the first arm.

In another aspect of the embodiment, the second arm has a proximal end and an opposite distal end and further includes an engagement element, the engagement element being disposed on the distal end.

In another aspect of the embodiment, the engagement element is configured to removably attach the second arm to the container.

In another aspect of the embodiment, the first arm has a proximal end and an opposite distal end and further includes a first surface and an outer second surface, the second surface further including at least one groove extending laterally between a proximal end of the first arm and the distal end of the second arm.

In another aspect of the embodiment, the loading funnel is affixed to the proximal end of the first arm.

In another aspect of the embodiment, the loading funnel further includes a head portion distal to the proximal end of the first arm.

In another aspect of the embodiment, the loading funnel further includes a neck portion disposed between the head portion and the proximal end of the first arm.

In another aspect of the embodiment, the head portion further defines a mouth.

In another aspect of the embodiment, the neck portion defines an aperture having a shape selected from the group consisting of discorectangular, circular, and oval.

In another aspect of the embodiment, the aperture is sized to receive at least a portion of a pushing device.

In another aspect of the embodiment, the neck portion further includes an attachment element, the attachment element configured to removably attach the loading funnel to at least a portion of the opening of the container.

In another aspect of the embodiment, at least a portion of the loading funnel defines a flat tapered surface.

In another aspect of the embodiment, the flat tapered surface is extending between the mouth and the neck portion of the loading funnel.

In yet another embodiment, the system utilizes a pushing device for loading organic smoking material into a container. The pushing device comprises a first portion sized and configured to engage an aperture of a loading funnel, an opposite second portion, and an elongated surface extending therebetween. The second portion further defines a finger receiving element sized and configured to receive at least a portion of a human finger and has a diameter larger than the first portion. Additionally, the finger receiving element includes an interior stopper element distal to the second portion to prevent the insertion of the human finger past a distance which is no more than half the length of the elongated surface.

In one aspect of the embodiment, the first portion defines a flat surface.

In one aspect of the embodiment, the first portion is a shape selected from the group consisting of discorectangular, circular, and oval.

In one aspect of the embodiment, the finger receiving element further includes a first concave portion configured to receive the human finger through the second portion of the device.

In one aspect of the embodiment, the finger receiving element further includes a second arcuate portion configured to receive at least a portion of the human finger to grasp the device when removing the device from the loading funnel.

In yet another embodiment is a system for loading organic smoking material into a container. The container having a first end defining an opening sized to receive the organic smoking material, an opposite second end, and a lateral surface extending therebetween. The system includes a loading funnel sized and configured to engage at least a portion of the opening and is affixed to a proximal end of a first arm. The loading funnel further includes a head portion distal to the proximal end of the first arm and a neck portion disposed between the head portion and the proximal end of the first arm. The head portion defines a mouth and the neck portion defines an aperture. Additionally, the neck portion includes an attachment element configured to removably attach the loading funnel to at least a portion of the opening of the container. Further, the first arm extends from the loading funnel and is configured to be adjacent to the lateral surface of the container when the loading funnel engages the opening. The loading funnel is also affixed to a proximal end of the first arm, the first arm including a first surface and an outer second surface. The second surface includes at least one groove extending laterally between the proximal end of the first arm and a distal end of an outer second surface of a second arm which extends orthogonally from the first arm. The second arm includes a first surface and the second surface, and is configured to releasably engage the second end of the container when the first arm is adjacent to the lateral surface of the container. The second arm further includes an engagement element disposed on the distal end of the second arm and configured to removably attach the second arm to the container.

The embodiment also includes a pushing device for loading organic smoking material into the container. The pushing device comprises a closed first portion shaped and configured to slidably engage the aperture of the loading funnel, and an opposite second portion having a diameter larger than the first portion. The first portion may also further define a flat surface. The opposite second portion defines a finger receiving element sized configured to receive at least a portion of a human finger. The finger receiving element further includes a first concave portion, a second arcuate portion, and an elongated surface extending therebetween. The first concave portion is configured to receive at least a portion of the human finger through the second portion and the second arcuate portion configured to receive at least a portion of the human finger to grasp the pushing device when removing the device from the loading funnel. Additionally, the finger receiving element includes an interior stopper element distal to the first portion to prevent the insertion of the human finger past a distance which is no more than half the length of the elongated surface.

The details of one or more aspects of the disclosure are set forth in the accompanying drawings and the description below. Other features, objects, and advantages of the techniques described in this disclosure will be apparent from the description and drawings, and from the claims.

BRIEF DESCRIPTION OF THE DRAWINGS

A more complete understanding of embodiments described herein, and the attendant advantages and features thereof, will be more readily understood by reference to the following detailed description when considered in conjunction with the accompanying drawings wherein.

DETAILED DESCRIPTION

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

As used herein, relational terms, such as "first" and "second," "top" and "bottom," and the like, may be used solely to distinguish one entity or element from another entity or element without necessarily requiring or implying any physical or logical relationship or order between such entities or elements. The terminology used herein is for the purpose of describing particular embodiments only and is not intended to be limiting of the concepts described herein. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Figure 1:
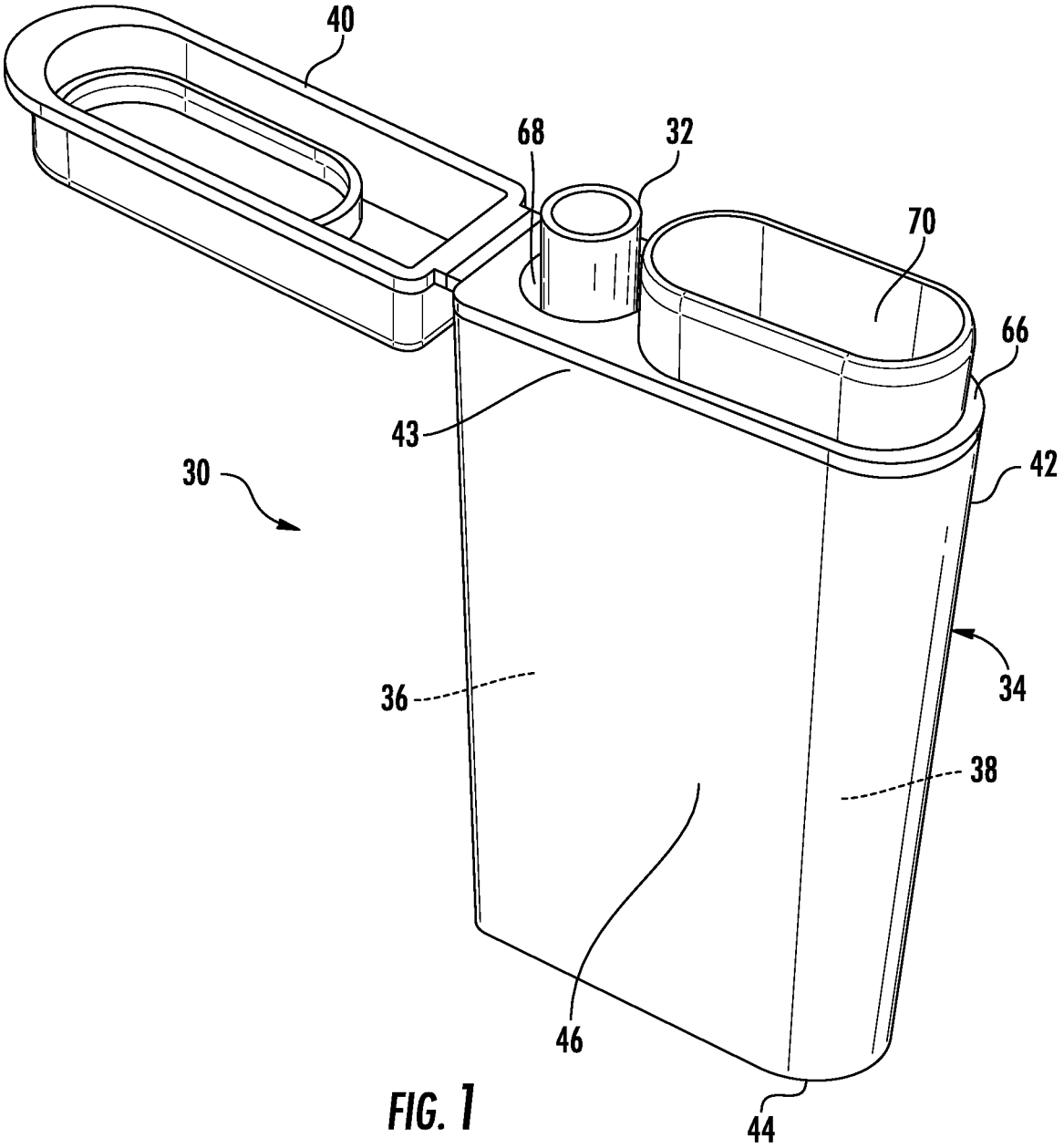
FIG. 1 shows a container for organic smoking material, the container configured to include a smoking device.
Figure 2:
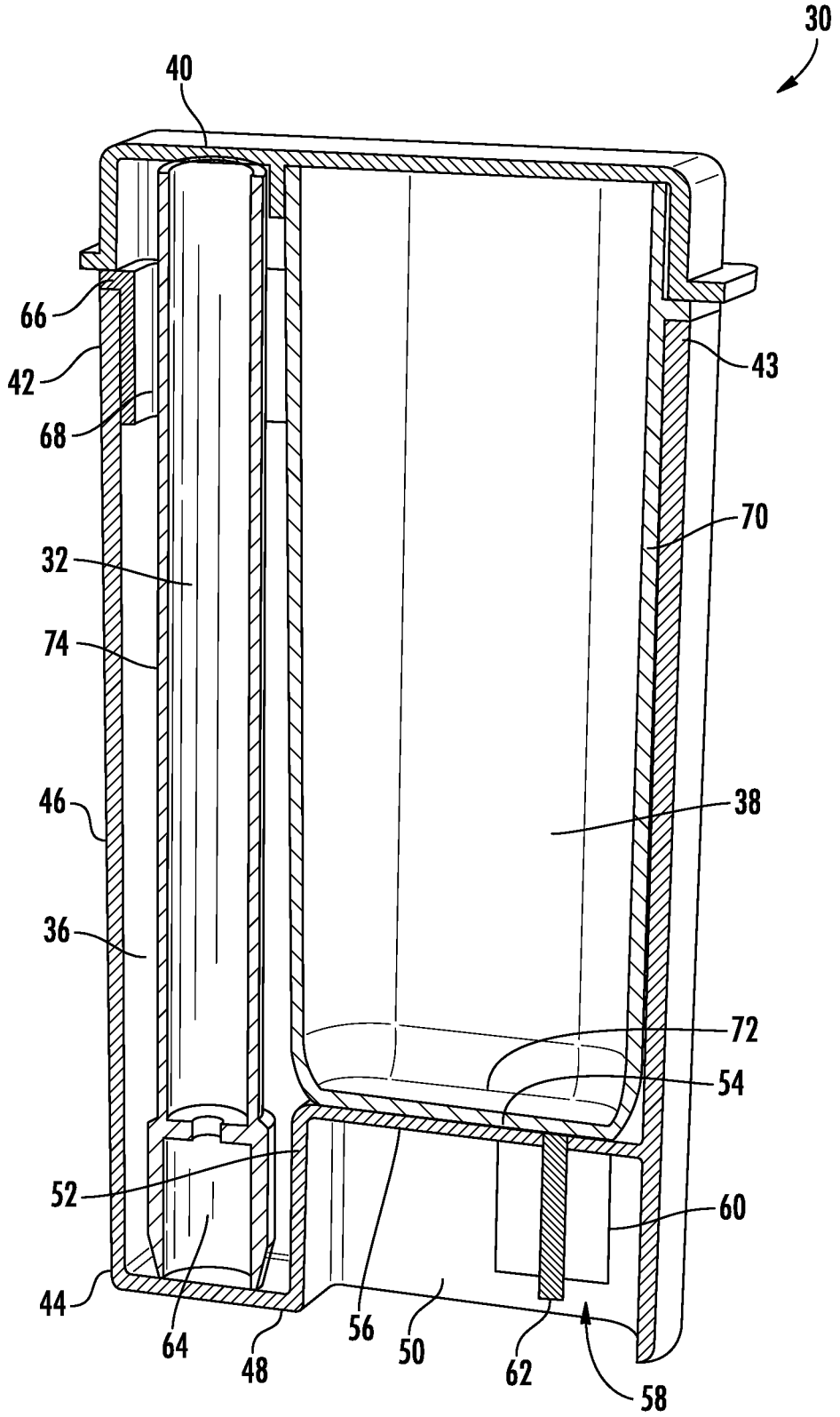
FIG. 2 shows a side cross-sectional view of the container of FIG. 1, with a lid in a closed position and the smoking device in a first compartment.
Figure 3:
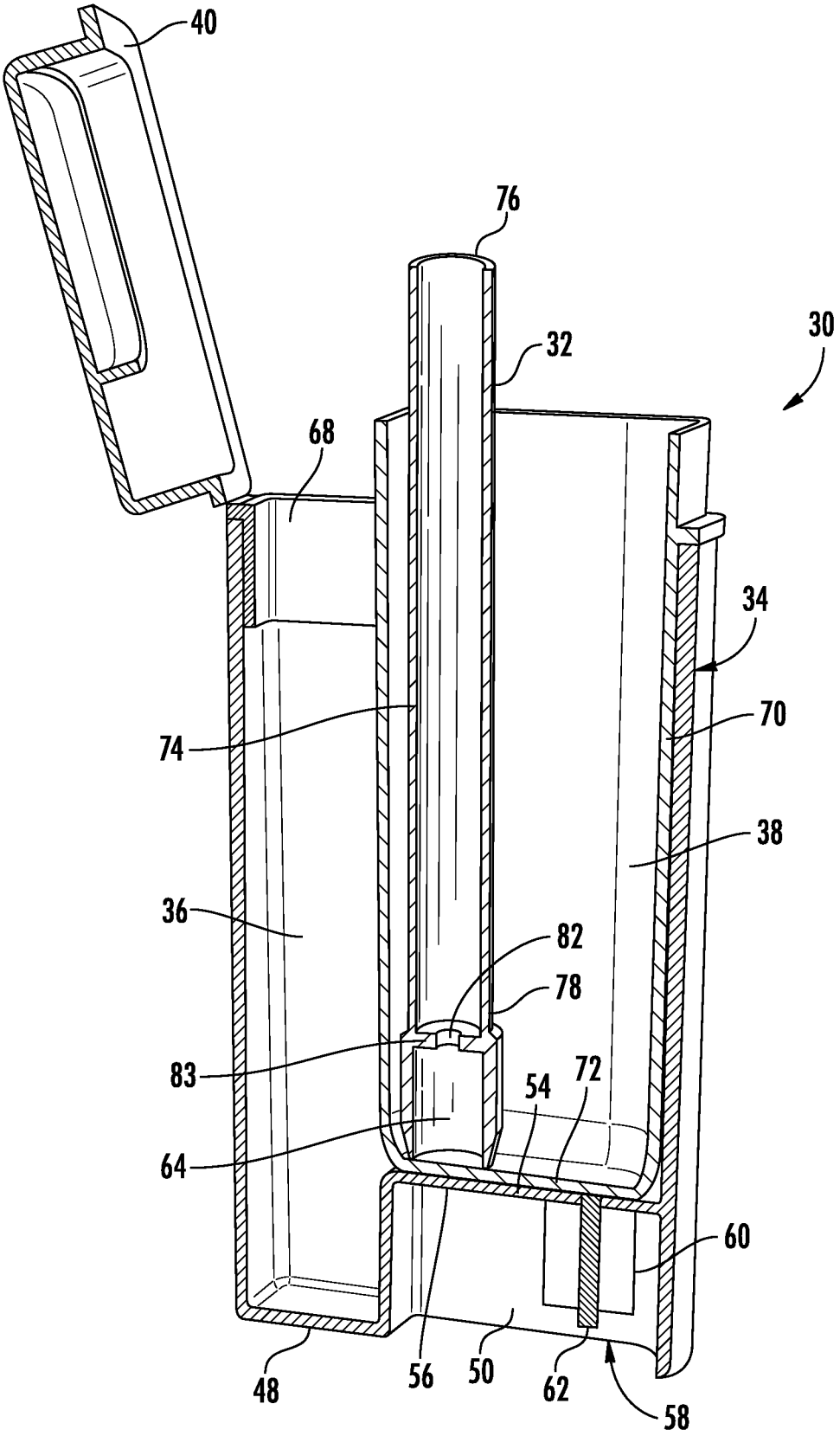
FIG. 3 shows a side cross-sectional view of the container of FIG. 1, with the lid in an open position and the smoking device in a second compartment.
Figure 4:
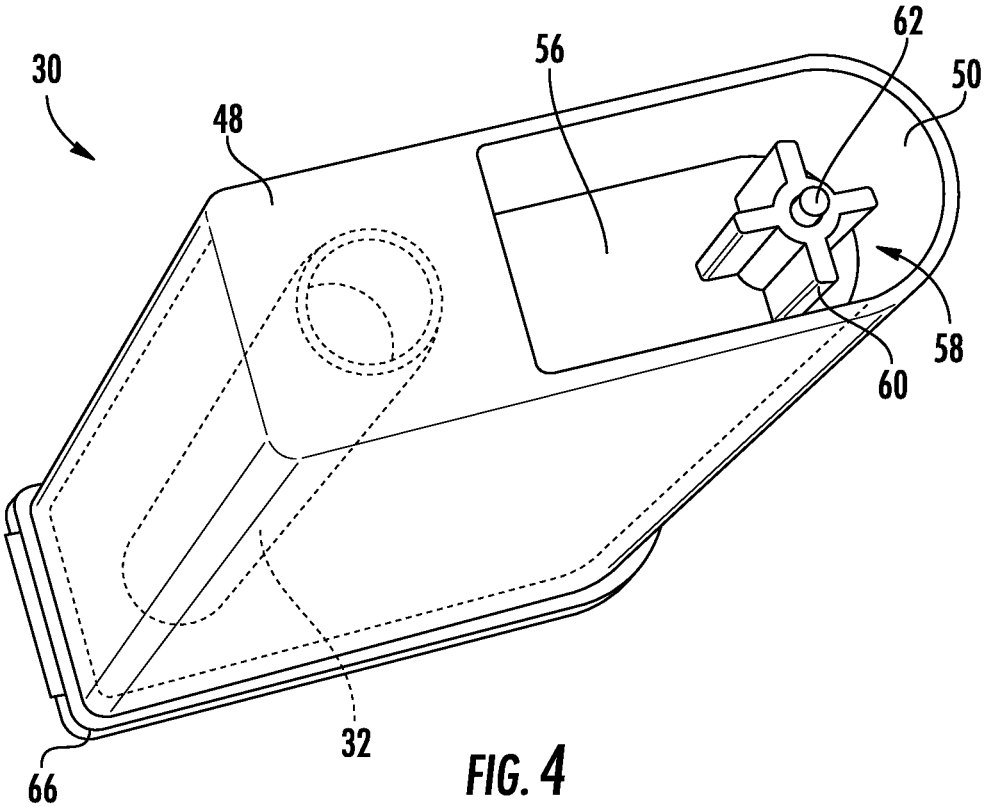
FIG. 4 shows a bottom perspective view of the container of FIG. 1.

Referring now to FIGS. 1-4, a container 30 is shown that is configured to contain an organic smoking material and a smoking device 32. In one embodiment, the container 30 generally includes a housing 34 that defines a first compartment 36 and a second compartment 38. The housing 34 also includes a lid 40. The housing may be composed of any suitable nonporous material that is cost effective for a single use and that is sturdy enough to be used without breaking. In one non-limiting example, the housing is composed of plastic such as polypropylene (PP). Further, the housing may have any suitable dimensions. In one non-limiting example, the housing may be approximately 3.0 inches tall, approximately 2.0 inches wide, and approximately ⅝ inch (0.6 inch) deep, and may be configured to contain up to twenty grams of organic smoking material (for example, marijuana colas and/or buds), without the need to cut or tear the organic smoking material into smaller pieces. The housing 34 may have right-angle edges and/or rounded or curved edges, such as is shown in FIGS. 1 and 4. However, it will be understood that other dimensions and configurations may also be used.

In one embodiment, the housing 34 includes an upper or first end 42, a lower or second end 44 opposite the first end 42, and a lateral surface 46 extending between the first and second ends 42, 44. The lateral surface 46 has a height that may at least substantially define the height of the housing 34, without the lid 40. Put another way, the height of the lateral surface 46 and the height of the lid 40 when the container 30 is closed may together define the height of the container 30. The first end 42 is an open end having a rim 43 and the second end 44 is a closed end that includes a lower surface 48 of the housing 34. Thus, the housing 34 defines a chamber therein.

As is shown in more detail in FIGS. 2-4, in one embodiment, the lower surface 48 includes a recessed portion 50 that extends into the chamber of the housing 34 to define a ledge 52. Put another way, the recessed portion 50 creates a stepped floor of the housing 34, giving the first compartment 36 a different depth within the housing 34 than the second compartment 38. In one embodiment, the recessed portion 50 is vertically aligned with the second compartment 38. The ledge has a first surface 54 located within the chamber of the housing 34 and a second surface 56 opposite the first surface 54 located within the recessed portion 50. In one embodiment, the recessed portion 50 includes a cleaning element 58 for cleaning and/or unclogging the smoking device 32 before and/or after use. In one embodiment, the cleaning element 58 extends from the second surface 56 of the ledge and has a length that is at most equal to the depth of the recessed portion 50, so the cleaning element 58 does not extend beyond the lateral surface 46 of the housing 34. In one embodiment, the cleaning element 58 includes a plurality of radially arranged fins 60 and a central shaft 62. Further, the central shaft 62 may have a height that is greater than a height of the fin(s) 60 such that the central shaft 62 protrudes beyond the fin(s) 60, allowing the central shaft 62 to unclog the central opening in the smoking device 32. In one embodiment, the cleaning element 58 is composed of the same material from which the housing 34 is composed, such as plastic, whereas the central shaft 62 is composed of a harder material, such as metal. However, other materials may also be used, and the entire cleaning element 58 may be composed of the same material, whether the same as or different from the rest of the housing 34. In use, the cleaning element 58 may be inserted into the bowl 64 of the smoking device 32 to remove ash or other particles or residue from the organic smoking material. Thus, the cleaning element 58 may be sized and configured to fit, in close tolerance, within the bowl 64 of the smoking device 32. However, it will be understood that the cleaning element 58 may have any suitable size, shape, or configuration that facilitates its use for cleaning the smoking device 32.

In one embodiment, the container 30 includes an insert 66 that defines an entry aperture 68 for the first compartment 36 and defines the wall of the second compartment 38. The lid 40 is hingedly coupled to the insert 66 at a location proximate the entry aperture 68 for the first compartment 36. Further, in one embodiment, the lid 40 and the insert 66 are manufactured as a single piece (for example, as shown in FIGS. 1-4). In another embodiment, the lid 40 is manufactured separately and is configured to be completely uncoupled from the container 30 (not shown). The first compartment 36 is sized and configured to receive and contain at least a portion of the smoking device 32 and, thus, the entry aperture 68 may be circular, in conformity with a cross-sectional shape of the smoking device 32. When the smoking device 32 is within the first compartment 36, at least a portion of the smoking device 32 protrudes from the entry aperture 68, as shown in FIGS. 1 and 2. Put another way, the depth of the first compartment 36 within the housing 34 is less than the length of the smoking device 32, such that at least a portion of the smoking device 32 is exposed from the first compartment 36 and can be easily grasped and removed from the container 30 by a user.

The portion of the insert 66 that defines the walls of the second compartment 38, which is referred to herein as the tub portion 70, is constructed such that the floor or base 72 of the tub portion 70 rests on, or is located in close or immediate proximity to (for example, within 2 mm from), the first surface 54 of the ledge 52. Thus, the tub portion 70, and therefore the second compartment 38, has a depth within the housing 34 that is less than the height of the lateral surface 46 of the housing 34. Further, in use, the base of the first compartment 36 is deeper within the housing 34 of the container 30 than the base of the second compartment 38 (for example, as shown in FIGS. 2 and 3). As is discussed in greater detail below, this configuration facilitates removal of the organic smoking material from the second compartment 38, either with the user's fingers or, more importantly, with the smoking device 32. Similarly, the depth of the second compartment 38 within the housing 34 is less than the length of the smoking device 32, which allows the user push one end of the smoking device 32 against the base 72 of the tub portion 70 to simultaneously cut and pack the smoking device 32 with a quantity of organic smoking material. When the insert 66 is coupled to the housing 34, the first compartment 36 is defined between the tub portion 70 and the walls of the housing 34. In one embodiment, at least a portion of the insert 66 is permanently or removably coupled to, in contact with, or adjacent to the upper first end 42 of the housing 34, such as to the rim 43 or to a portion of the housing located proximate the rim 43, by known means such as adhesive bonding, chemical bonding, friction fit, or the like. Alternatively, the insert 66 and the housing 34 may be manufactured as a single integrated piece, with the insert 66 and the housing 34 being inseparable.

At least a portion of the tub portion 70 may extend beyond the rim 43 of the first end 42 of the housing 34. Further, the lid 40 is recessed to receive the portion of the smoking device 32 that extends from the housing 34, and meets to form a seal against the portion of the tub portion 70 that extends beyond the rim 43. Thus, a seal, and in some embodiments an airtight seal, may be formed between the lid 40 and at least the second compartment 38, which prevents humidity and odor from escaping from the container 30.

Figure 5:
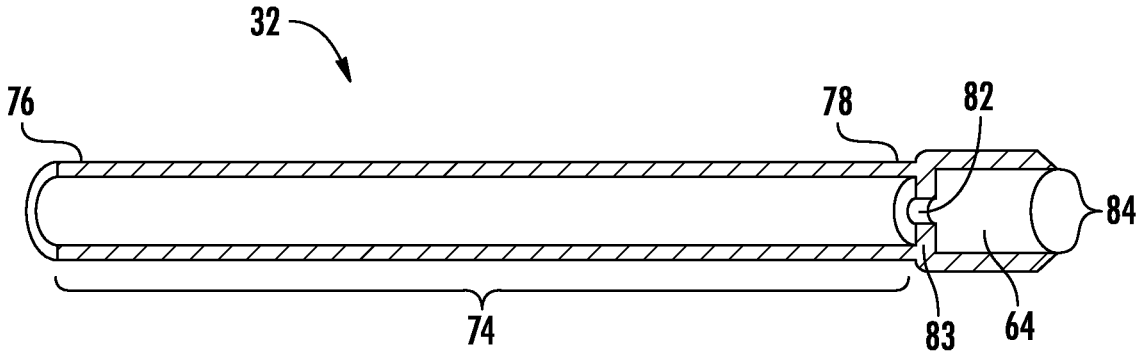
FIG. 5 shows a side cross-sectional view of the smoking device.
Figure 6:
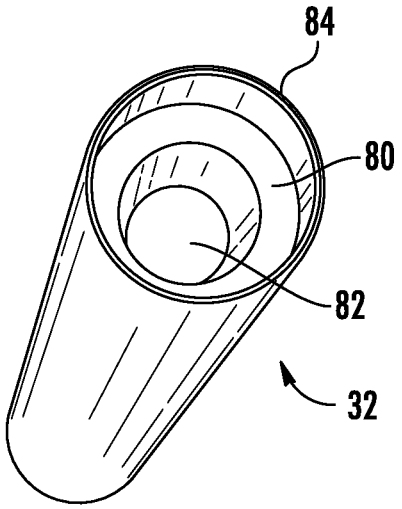
FIG. 6 shows a perspective view of a first end of the smoking device of FIG. 5.
Figure 7:
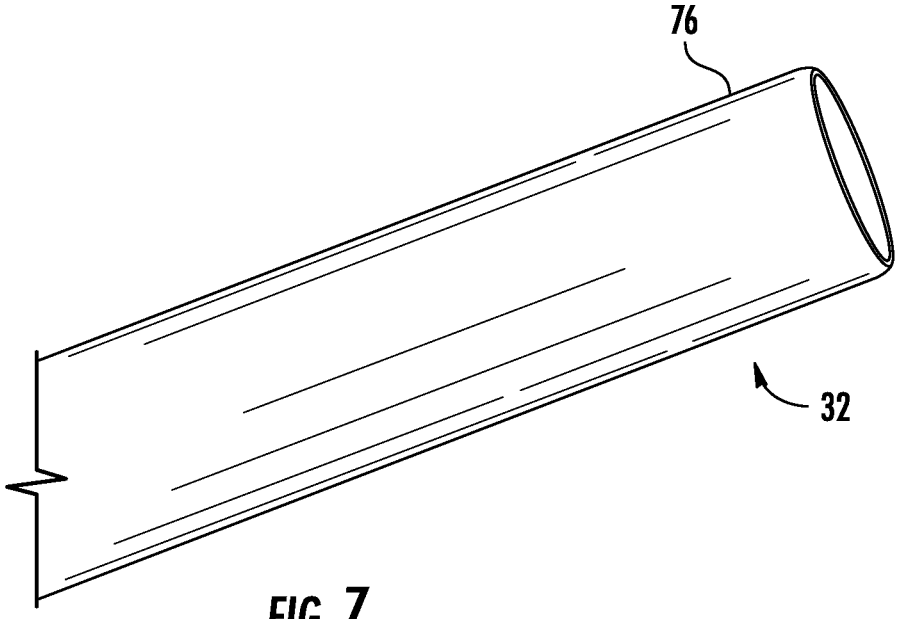
FIG. 7 shows a side view of a second end of the smoking device of FIG. 5.

Referring now to FIGS. 5-7, the smoking device 32 is shown in more detail. The smoking device 32 generally includes an elongate stem 74 and a bowl 64. The stem 74 includes a free first end 76 and a second end 78 opposite the first end 76 that meets the bowl 64. In one embodiment, the stem 74 has a continuous outer diameter between the first and second ends 76, 78, and the bowl 64 is generally tubular with an outer diameter that is greater than the outer diameter of the stem 74. The length of the stem 74 is greater than the length of the bowl 64. Further, the length of the entire smoking device 32 is greater than the depth of the second compartment 38 within the housing 34, allowing the user to push the bowl 64 against the base 72 of the tub portion 70 which still grasping the free first end 76 of the smoking device 32. Optionally, the smoking device 32 includes one or more transition areas between the stem 74 and the bowl 64 (for example, tapering or stepped outer diameters). Additionally, in one embodiment, the inner diameter of the bowl 64 is approximately the same, or only slightly larger, than the inner diameter of the stem 74. Thus, the inner diameter of the stem 74 is relatively large as compared with the inner tapered/reduced diameter of the bowl 64 to facilitate inhalation of smoke from the bowl 64.

In one embodiment, as shown in FIG. 6, the bowl is formed by an insert 80 that is positioned within the stem 74 to form a constriction point between the bowl 64 and a remainder of the stem 74. In one embodiment, the insert 80 includes a tapered aperture 82 having an inner diameter at a first end proximate the bowl 64 that is greater than an inner diameter at a second end opposite the first end. Alternatively, the aperture 82 may be tapered in the opposite direction or the aperture 82 may be tubular with an untapered aperture. In another embodiment, as shown in FIG. 4, the smoking device 32 is manufactured with the constriction point, which may be an annular flange 83 within the second end 78 of the stem 74, where it defines the base of the bowl 64. The annular flange 83 may define a tapered aperture, with an inner diameter at a first end proximate the bowl 64 that is greater than an inner diameter at a second end opposite the first end. Alternatively, the aperture 82 of the annular flange 83 may be tapered in the opposite direction or the aperture 82 may be tubular with an untapered aperture. In any embodiment, the aperture 82 is sized to allow smoke to pass therethrough but prevent the like passage of organic smoking material.

As is shown in FIGS. 2-7, the bowl 64 defines a rim that is tapered to give the smoking device 32 a sharpened free edge 84. Conversely, the second end 78 of the stem 74, which is configured to engage a user's lips, may optionally be rounded for user comfort. In use (and as shown in FIG. 3), the user grasps the free first end 76 of the smoking device 32 and inserts the sharpened free edge 84 into the second compartment 38, which contains the organic smoking material (not shown) and pressed against the base 72 of the tub portion 70 (thus, the base of the second compartment 38). In this manner, the organic smoking material is pinched between the sharpened free edge 84 and the base 72 of the tub portion 70, driving the organic smoking material into and packing the bowl 64, which allows the smoking device 32 to both easily and simultaneously cut a portion of the organic smoking material and to fill the bowl 64 with a predetermined amount. Thus, the smoking device 32 may be loaded without removing the organic smoking material from the container 30 and without the user having to handle the organic smoking material. In one embodiment, the bowl 64 may be sized and configured to contain a pre-determined amount or dosage. For example, the bowl 64 may be sized and configured to contain enough organic smoking material for a single dose or inhalation. Alternatively, the bowl 64 may be sized and configured to contain a larger amount of the organic smoking material.

Figure 8:
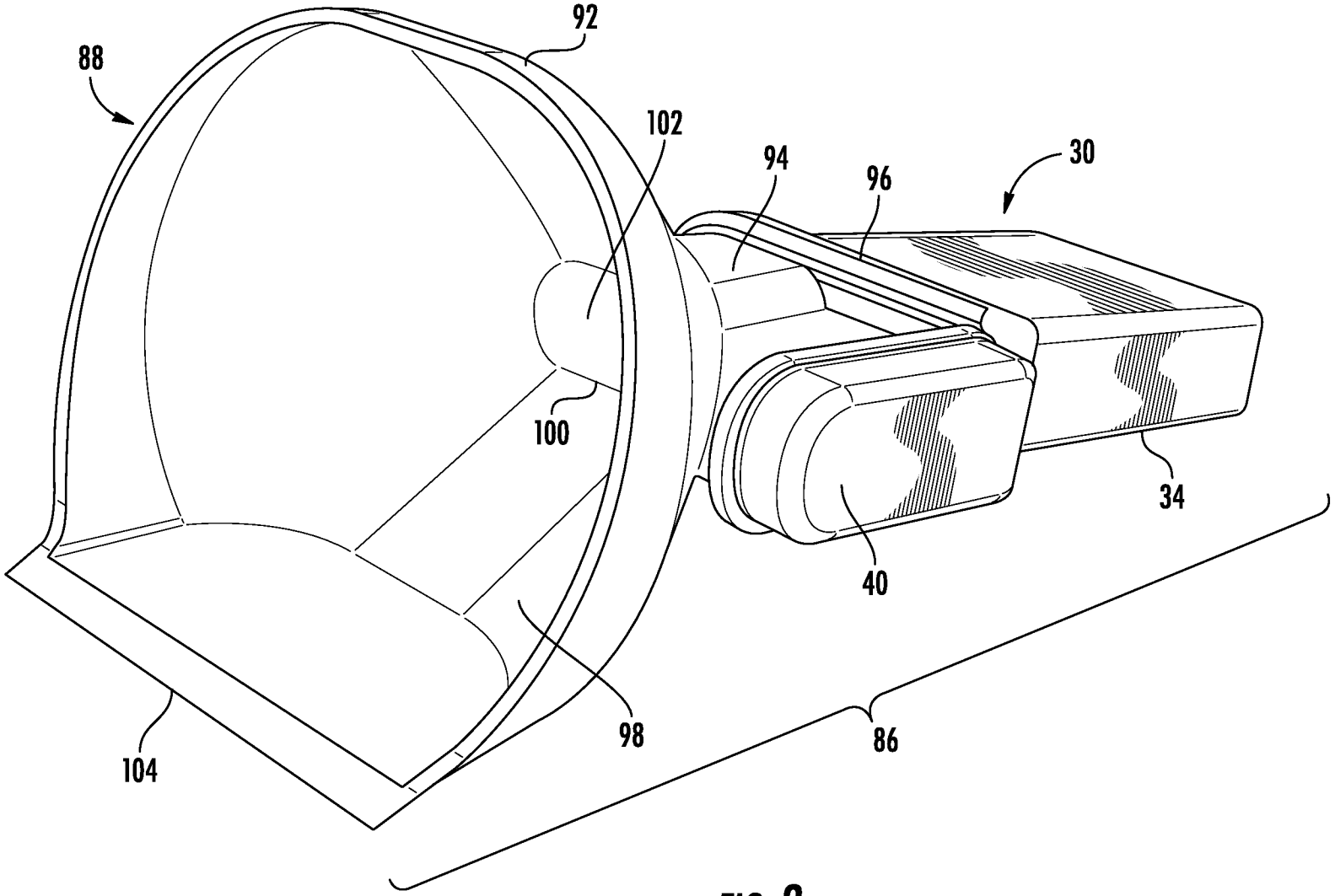
FIG. 8 shows a perspective view of the container of FIG. 1 with a removably attached loading funnel.
Figure 9:
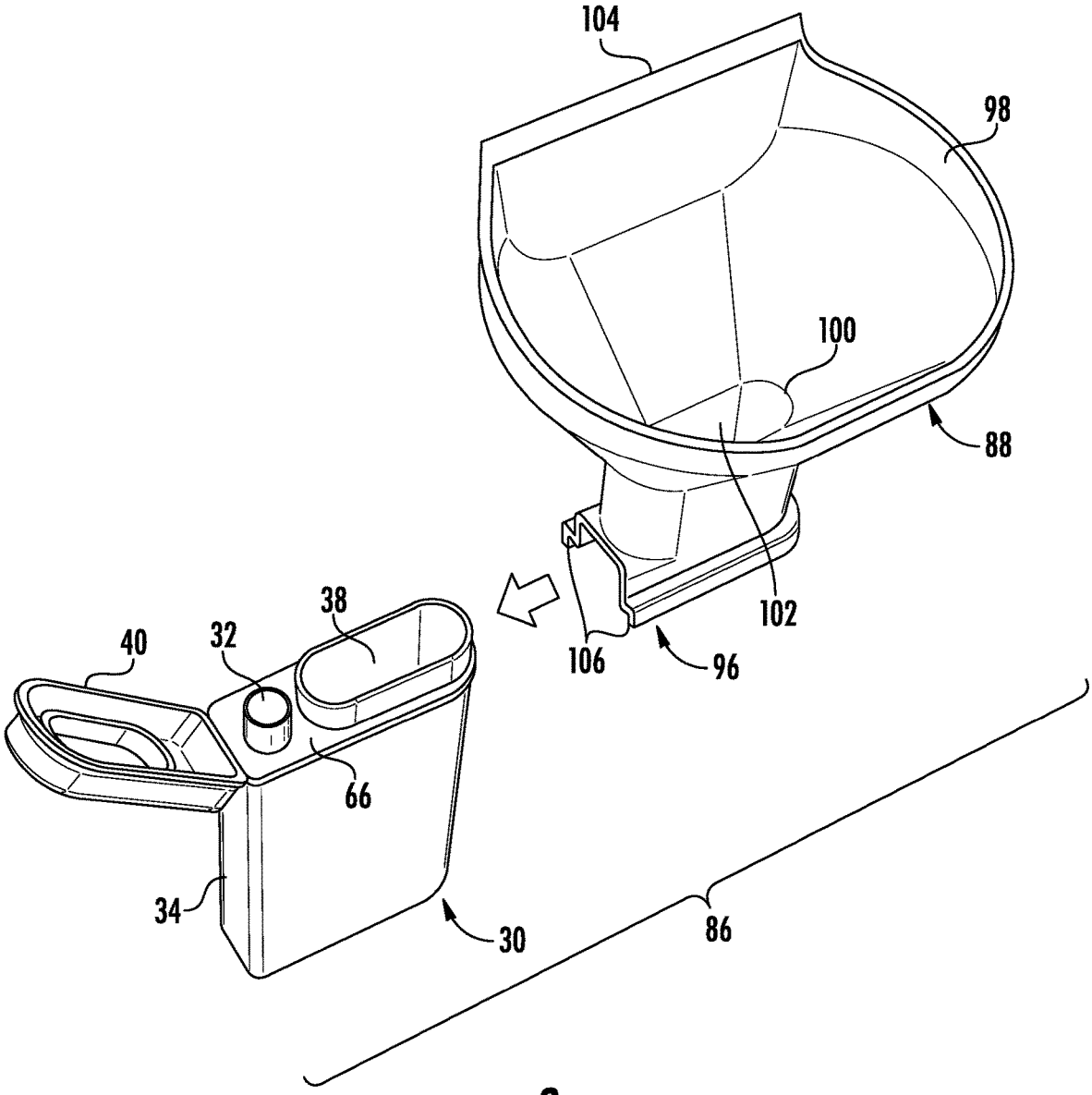
FIGS. 9 and 10 show the attachment of the loading funnel to the container.
Figure 10:
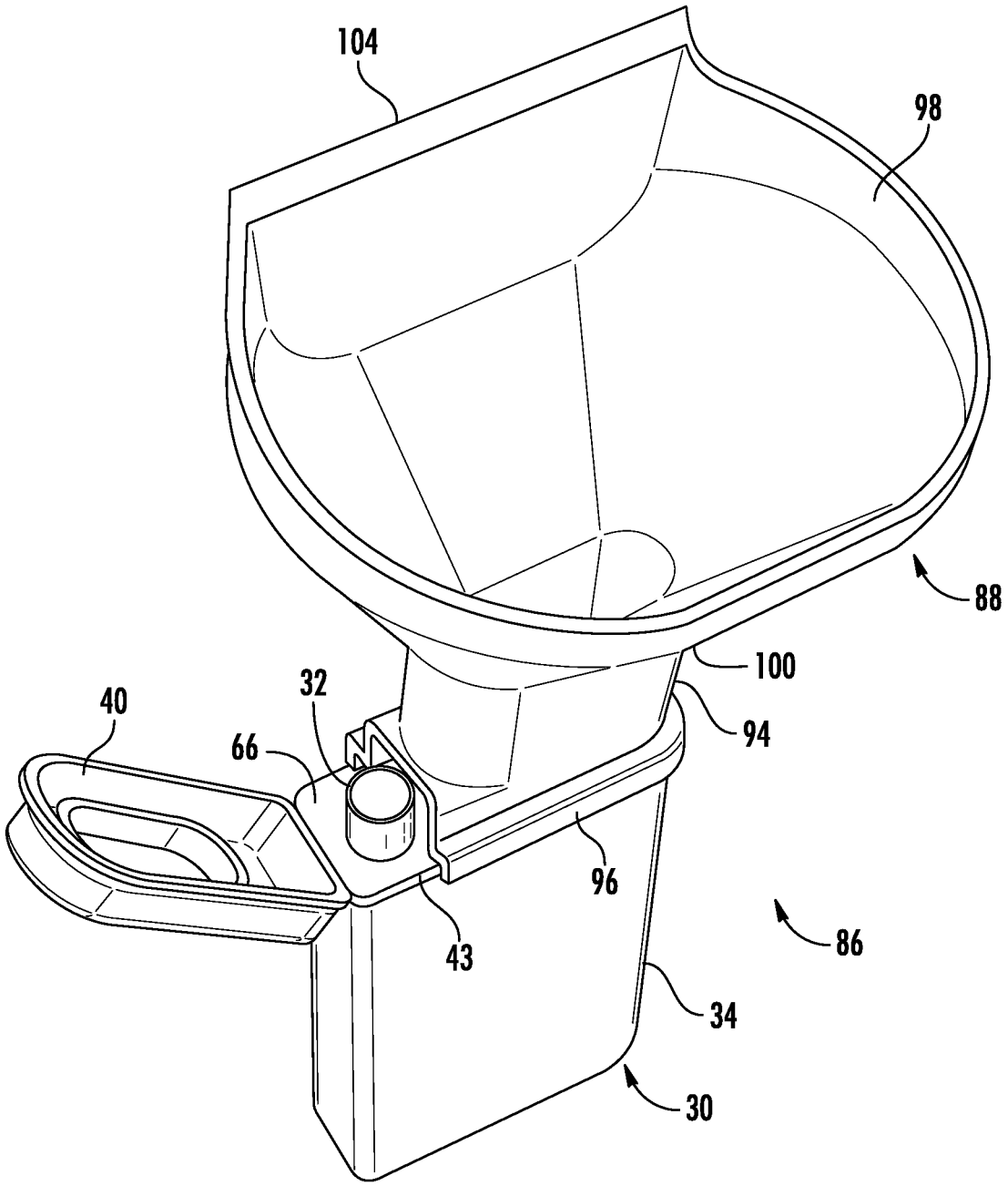

Referring now to FIGS. 8-11, a loading funnel 88 and use thereof is shown. In one embodiment, the container 30 is a component of a system 86 that includes the container 30, a loading funnel 88, and, optionally, a pushing device 90. As shown in FIGS. 8 and 10, a loading funnel 88 may be attached to the container 30 to facilitate the insertion of organic smoking material into the second compartment 38. In one embodiment, the loading funnel 88 generally includes a head portion 92, a neck portion 94, and at least one attachment element 96. In one embodiment, the head portion 92 generally has a conical or funnel shape, with a first end defining a mouth 98 and a constricted second end 100. The mouth 98 has a diameter that is greater than a diameter of the constricted second end 100. The constricted second end 100 is joined to, or transitions into, the neck portion 94. The neck portion 94 has an outer diameter that is approximately the same as the outer diameter of the most proximate portion of the constricted second end 100. Further, the neck portion 94 defines an aperture 102 therethrough. The aperture 102 is shown in FIGS. 8-11 as having a generally oval, or rounded rectangle, shape. However, it will be understood that the aperture 102 may have any suitable size, shape, or configuration that facilitates the insertion of organic smoking material into the second compartment 38. The outer surface of the neck portion 94 may have the same cross-sectional shape as the aperture 102.

Further, in one embodiment, at least a portion of the mouth 98 includes a tapered straight edge 104, similar to a dustpan. In use, the tapered straight edge 104 can be rested on a flat surface and organic smoking material can be swept into the mouth 98 and the head portion 92 of the loading funnel 88. The container 30, and the loading funnel 88, may then be righted such that the lower surface 48 of the housing 34 is resting on the flat surface and the loading funnel 88 extends upward from the container 30 and the second compartment 38. In this position, the organic smoking material falls from the head portion 92, through the neck portion 94, and into the second compartment 38.

The at least one attachment element 96 is configured to releasably attach the loading funnel 88 to the container 30. The head portion 92, the neck portion 94, and the attachment element(s) 96 may be manufactured as a single piece, with the attachment element(s) 96 extending from, incorporated into, or proximate the neck portion 94. In one non-limiting example, the attachment element(s) 96 include at least one rail 106 sized and configured to extend over, matably attach to, accept, or otherwise couple to at least a portion of the housing 34, such as the rim 43 (which may protrude beyond the lateral surface 46 of the housing 34) and/or the insert 66. It will be understood that the attachment element(s) 96 may have any size, shape, and/or configuration that, when the lid 40 is open, allows the loading funnel 88 may be slid onto, snapped onto, or otherwise releasably coupled to the container 30.

Figure 11:
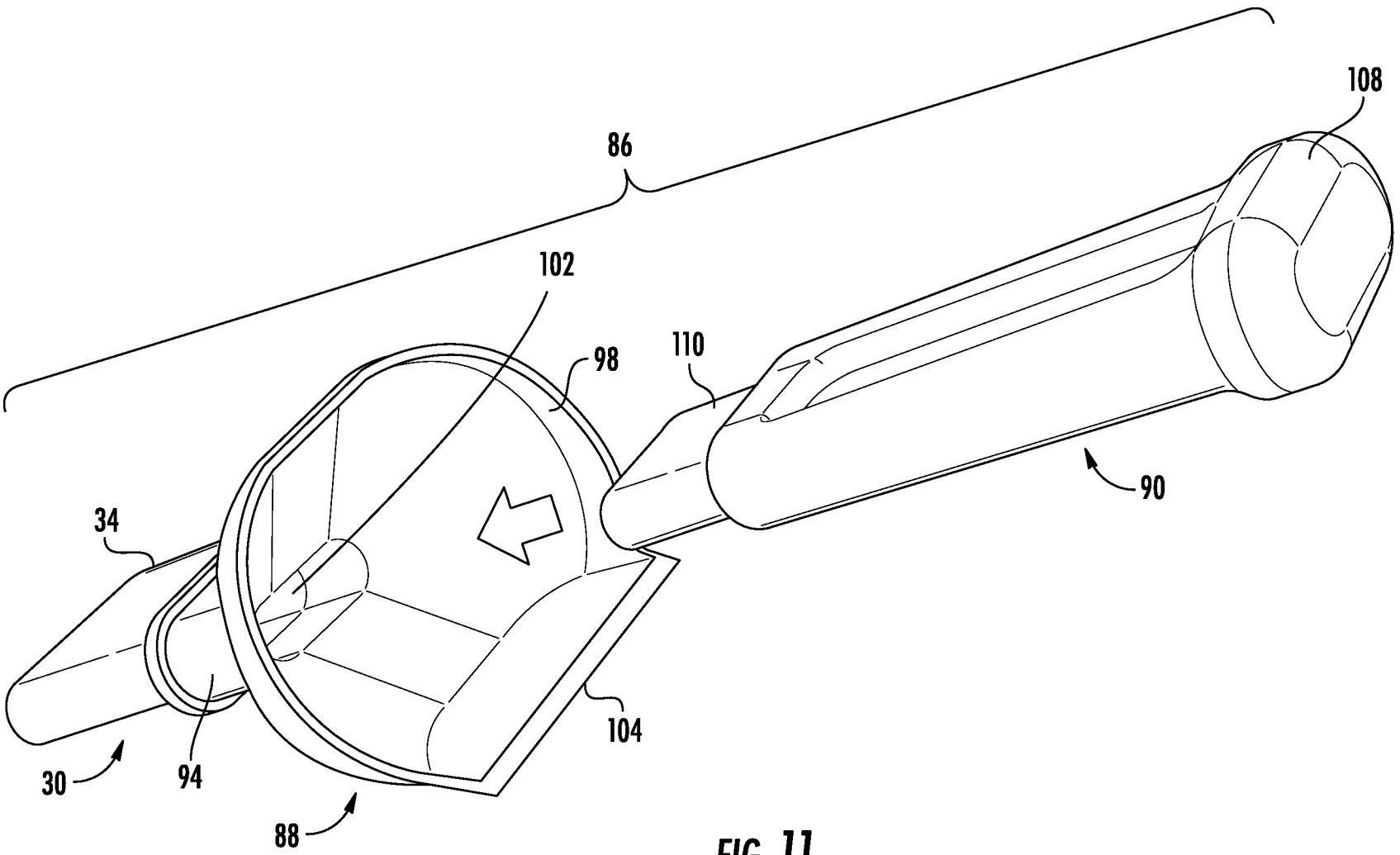
FIG. 11 shows a pushing device and the container with loading funnel.

As shown in FIG. 11, the system 86 may also include a pushing device 90. In one embodiment, the pushing device 90 is elongate with a first end 108 that is configured to be grasped by a user and a second end 110 opposite the first end 108 that is configured to be at least partially inserted into the aperture 102 of the neck portion 94 of the loading funnel 88. As shown in FIG. 11, the first end 108 may have an outer diameter that is greater than an outer diameter of the second end 110. Further, the second end 110 is sized and shaped to fit within the aperture 102 of the neck portion 94. In one non-limiting example, the aperture 102 of the neck portion 94 and the second end 110 of the pushing device 90 each have an oval or rounded rectangular cross-sectional shape.

Figure 12:
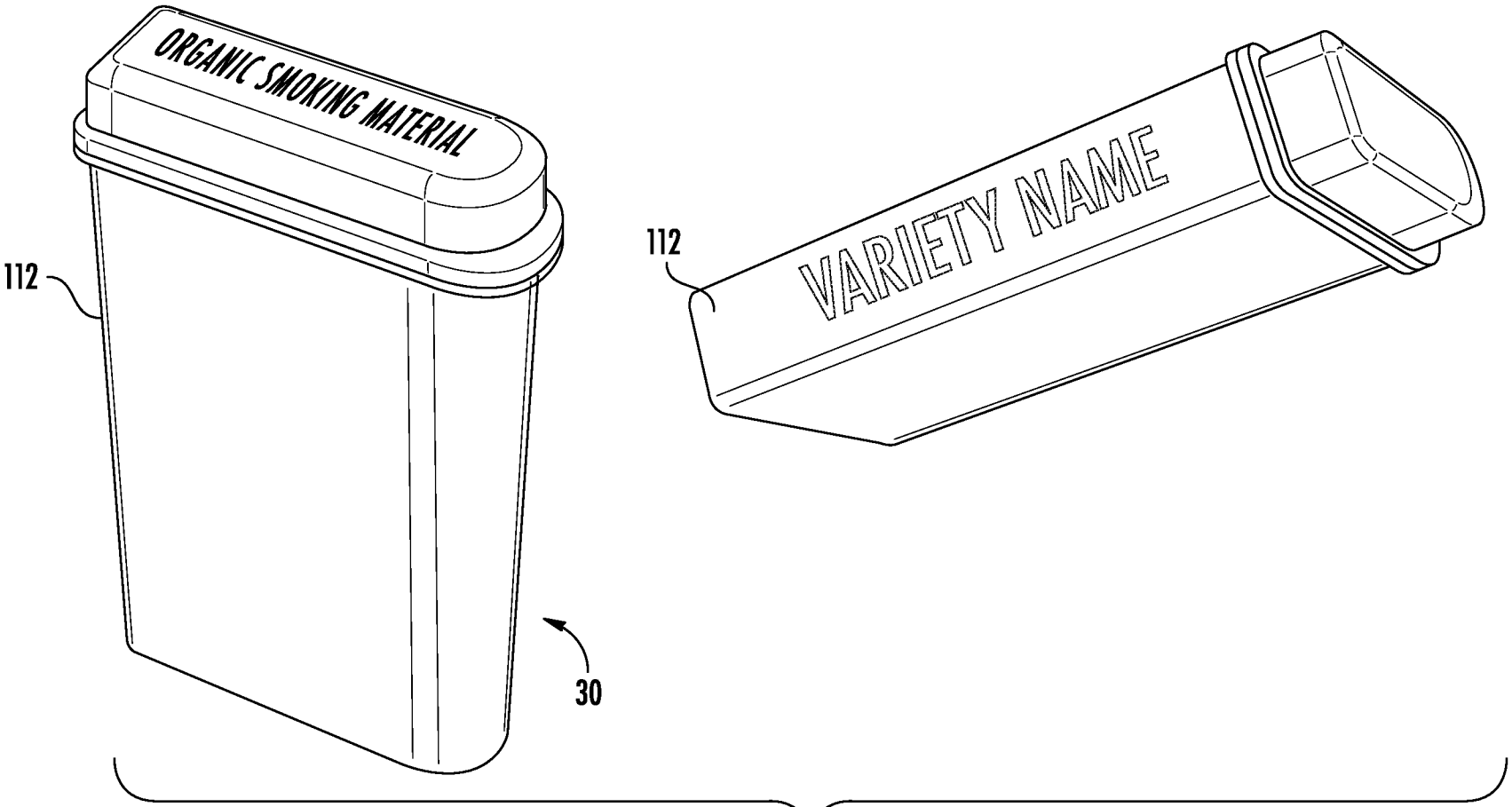
FIG. 12 shows an exemplary packaging design for the container.

FIG. 12 shows an exemplary packaging design for the container 30. One or more surfaces of the container 30 may be configured for marking with such indicia as a dispensary name, an identification of the contents of the second compartment 38, prescription dosage instructions, business logo, standard text, or the like. In the embodiment shown, the housing 34 has a generally rectangular shape, with the lateral surface 46 having at least one flattened face 112, such as one of the narrow faces extending between the first end 42 and the second end 44 of the housing 34. Optionally, the housing 34 may be composed of an amber-colored material and the lid may be composed of a white-colored material, similar to a typical prescription bottle. A blank or pre-marked sticker may be affixed to the flattened face 112, so information written or printed on the sticker (or written or printed directly on the flattened face 112) is visible when, for example, the container is placed on a shelf. The lid 40 and/or other portions of the container 30, loading funnel 88, and/or pushing device 90 may be similarly marked.

Some embodiments advantageously provide device and system for packaging, storing, and smoking an organic smoking material, and a method of using same. In one embodiment, a container comprises: a housing defining a chamber; a first compartment within the chamber, the first compartment having a first depth; a second compartment within the chamber adjacent the first compartment, the second compartment having a second depth that is less than the first depth; and a lid configured to provide an airtight seal to at least the second compartment.

In one aspect of the embodiment, the housing includes a first end defining a rim and a second end opposite the first end, the container further comprising: an insert coupled to the rim of the first end and at least partially extending into the chamber, the lid being hingedly coupled to the insert, the insert including: an aperture aligned with the first compartment; and a tub portion that defines the second compartment when the insert is coupled to the rim of the first end.

In one aspect of the embodiment, the second end of the housing includes a recessed portion that extends into the chamber and is aligned with the tub portion.

In one aspect of the embodiment, the tub portion has a base that is one of in contact with and immediately proximate the recessed portion that extends into the chamber.

In one aspect of the embodiment, the container further comprises a cleaning element within the recessed portion, the cleaning element including a plurality of radially arranged fins surrounding a central shaft, the central shaft protruding beyond the plurality of radially arranged fins.

In one aspect of the embodiment, the first compartment is configured to contain a smoking device and the second compartment is configured to contain an organic smoking material, the first depth of the first compartment being such that at least a portion of the smoking device protrudes from the first compartment when the smoking device is contained within the first compartment.

In one aspect of the embodiment, the first compartment is configured such that at least a portion of the smoking device protrudes from the first compartment when the smoking device is contained within the first compartment and when the lid is in a closed position.

In one embodiment, system for containing and using an organic smoking material comprises: a container including a housing having a first compartment, a second compartment, and a lid, the first compartment being deeper than the second compartment, the lid being configured to provide an airtight seal to at least the second compartment; and an elongate smoking device configured to be contained within the first compartment, the elongate smoking device having a length that exceeds a depth of the first compartment such that at least a portion of the elongate smoking device protrudes from the first compartment when the elongate smoking device is contained within the first compartment, the elongate smoking device having a stem portion and a bowl portion, the bowl portion having a sharpened free edge.

In one aspect of the embodiment, the housing includes a lower surface having a recessed portion that extends into the housing, the recessed portion having a cleaning element that has a plurality of radially arranged fins surrounding a central shaft, the cleaning element being configured to be inserted into the bowl portion of the elongate smoking device.

In one aspect of the embodiment, the system further comprises a loading funnel configured to be removably attached to at least a portion of the container and aligned with the second compartment, the loading funnel including a head portion, a neck portion including an aperture, and at least one attachment element, at least a portion of the head portion having a straight edge.

In one aspect of the embodiment, the system further comprises a pushing device including a first end and a second end opposite the first end, at least a portion of the second end being configured to be inserted into the aperture of the neck portion of the loading funnel.

Figure 13:
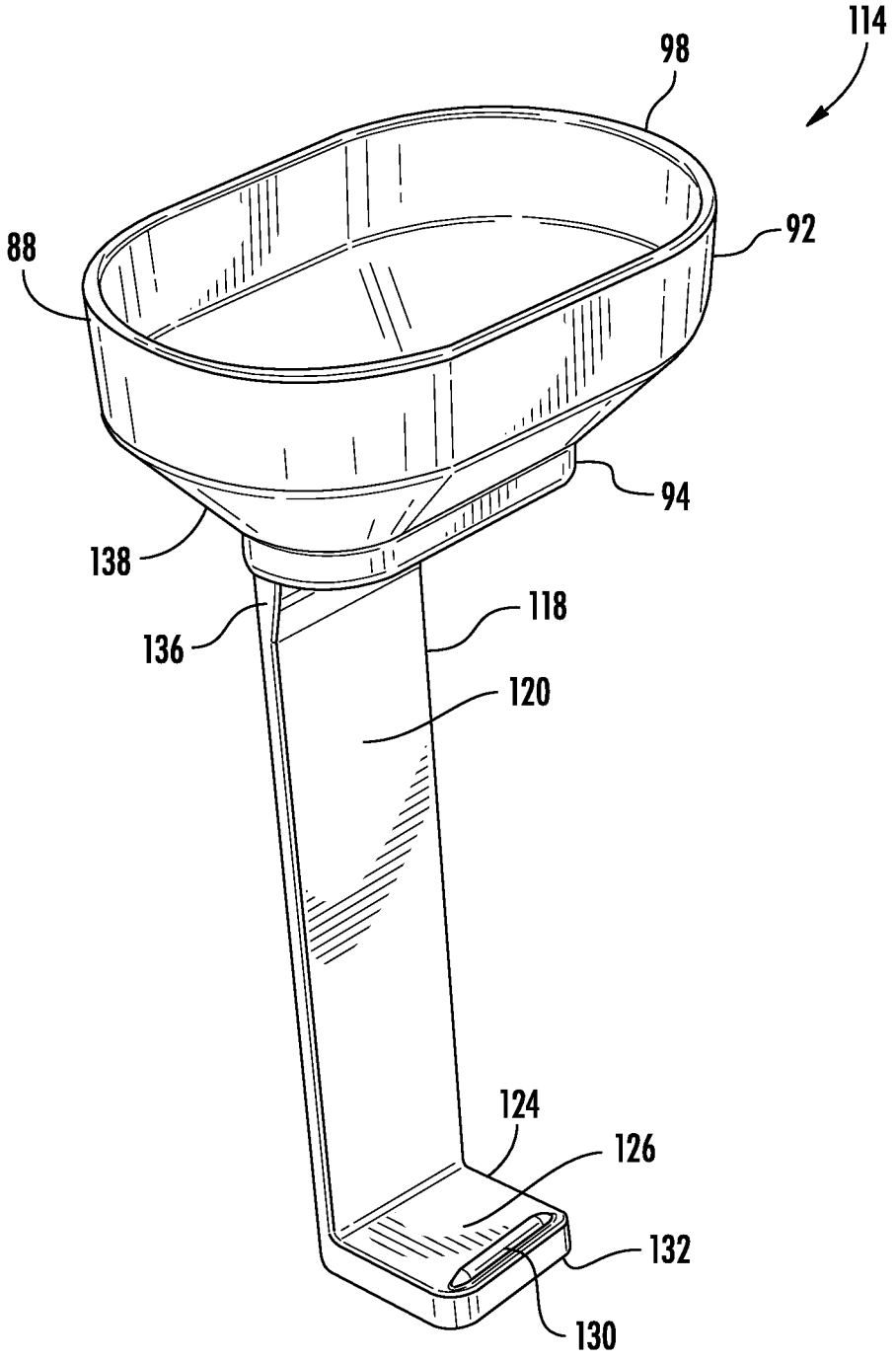
FIG. 13 shows a perspective view of the loading device.
Figure 14:
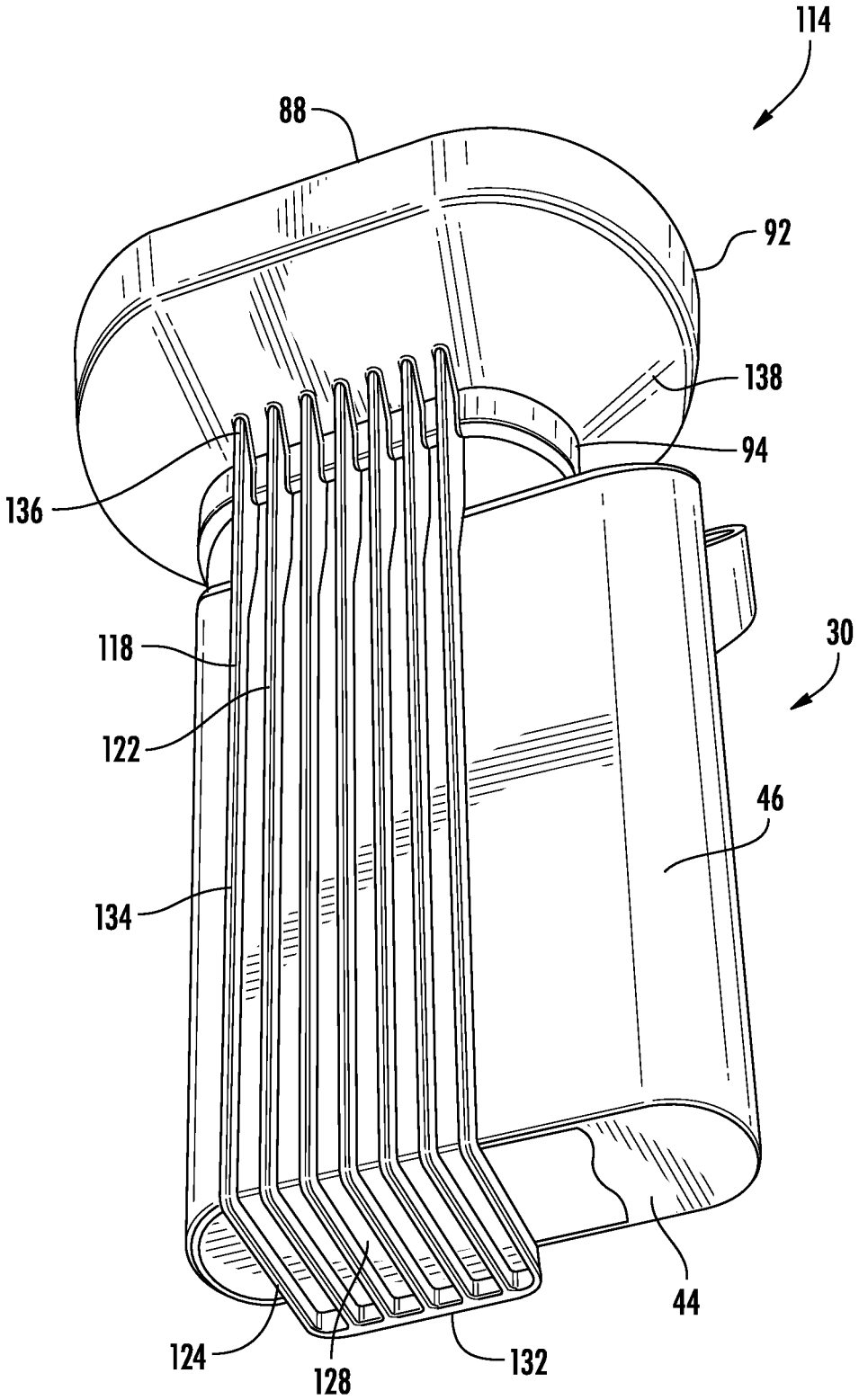
FIG. 14 shows a back view of the attachment of the loading device of FIG. 13 and the container of FIG. 1.
Figure 16:
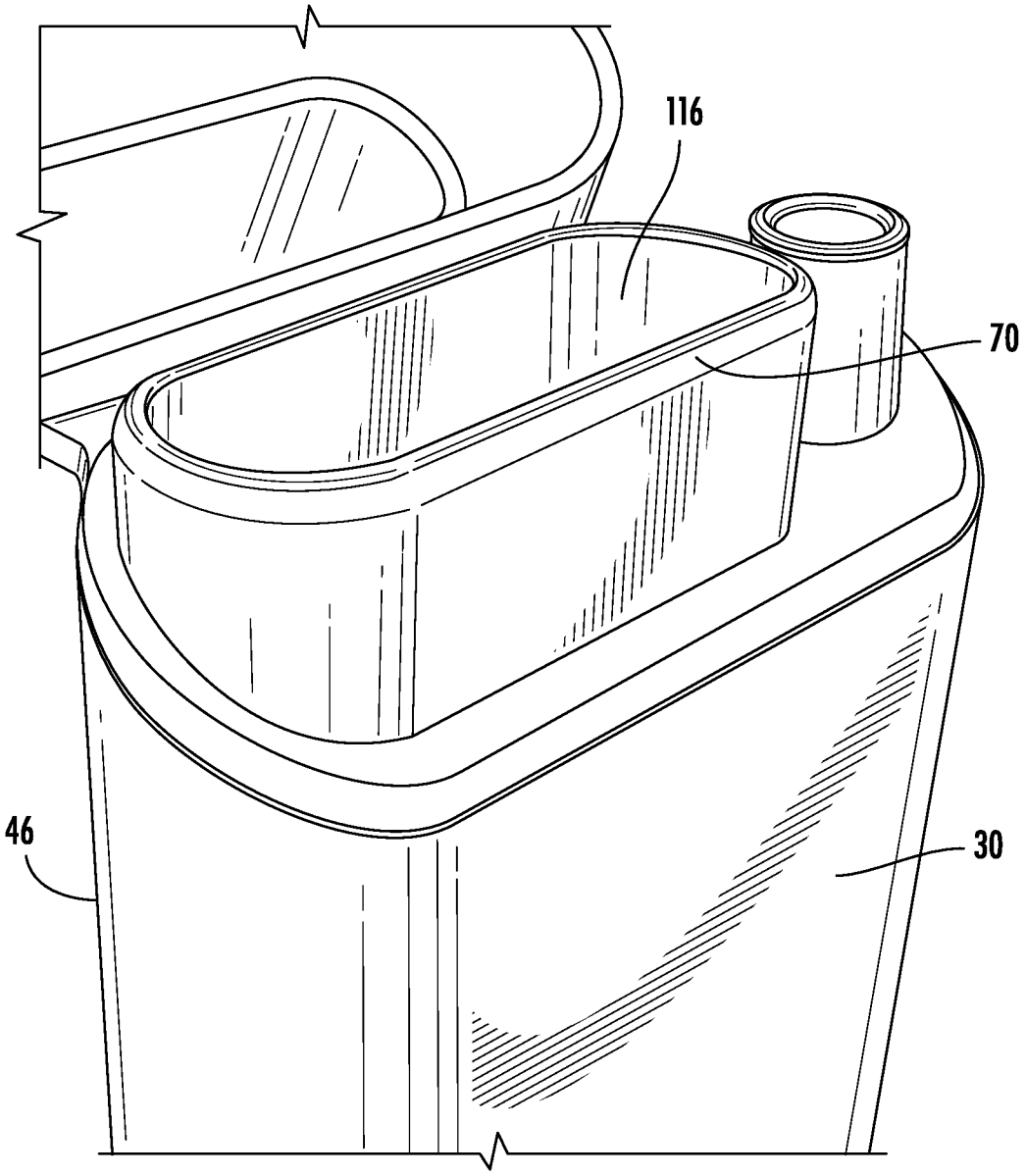
FIG. 16 shows a perspective view of the first end of the container of FIG. 1.

Referring now to FIGS. 13-14 and 16, in another embodiment, loading device 114 includes a loading funnel 88, or other type of inlet device configured to attach to the container 30 in which organic smoking material may be deposited. The loading device 114 is sized and configured to engage at least a portion of an opening 116 defined by the tub portion 70 of the container 30. The loading device 114 may include a first arm 118 having a first surface 120 and an outer second surface 122. The first arm 118 extends from the loading funnel 88 and is configured to be adjacent to the lateral surface 46 of the container 30 when the loading funnel 88 engages the opening 116. In one configuration, the first surface 120 of the first arm 118 is directly adjacent or "flush" with the lateral surface 46 of the container 30. However, in other embodiments there may be a space or gap been the first surface 120 of the first arm 118 and the lateral surface 46 of the container 30. The loading device 114 may also include a second arm 124 extending from the first arm 118 configured to releasably engage the second end 44 of the container 30 when the first arm 118 is adjacent to the lateral surface 46 of the container 30.

In one embodiment, the second arm 124 extends orthogonally from the first arm 118 and has a first surface 126 and an outer second surface 128. The first surface 126 further includes an engagement element 130 configured to removably attach the second arm 124 to the container 30. The engagement element 130 may be disposed on a distal end 132 of the first surface 126 of the second arm 124. In other embodiments the engagement element 130 may be disposed on any location of the second arm 124 that would facilitate the attachment of the second arm 124 to the container 30. The first arm 118 may also have a longer length than the second arm 124. Additionally, both the first arm 118 and the second arm 124 may be rigid or flexible.

In one exemplary embodiment, the engagement element 130 may be a clip or any other type of fastener configured to releasably engage the second end 44 of the container 30. Additionally, the second arm 124 may have a length that is the same or longer than the first arm 118. In another embodiment, the first arm 118 and the second arm 124 may also be flexible to facilitate engagement of the second arm 124 to the second end 44 of the container 30.

Referring now to FIG. 14, the first arm 118 includes at least one groove 134 extending laterally between the first arm 118 and the second arm 124. The at least one groove 134 is disposed on the outer second surface 122 of the first arm 118 and the outer second surface 128 of the second arm 124. In one embodiment, the at least one groove 134 extends laterally between a proximal end 136 of the first arm 118 and the distal end 132 of the second arm 124. However, in other embodiments, the at least one groove 134 may extend laterally between any end of the first arm 118 and the second arm 124. In another embodiment, the first arm 118 may not include the at least one groove 134. Rather, the second surface 122 of the first arm 118 may be configured to have a smooth flat surface extending laterally between the proximal end 136 and the distal end 132.

In one embodiment, the at least one groove 134 is sized and configured to function as a mating member for a clip or other type of fastener so that the loading device 114 may be attached to a user's clothing, bags, or other types of travel accessories.

In the embodiment in which the first arm 118 has a smooth flat second surface 122, a hook-and-loop type fastener or other type of adhesive may be attached to the second surface 122 so that the loading device 114 may be removably mounted or attached to a wall, desk, or other type of surface at a user's discretion.

Continuing to refer to FIGS. 13-14, the loading funnel 88 may be affixed to the proximal end 136 of the first arm 118. The loading funnel 88 may include a head portion 92 and a neck portion 94. The head portion 92 may be distal to the proximal end 136 of the first arm 118, and the neck portion 94 may be proximate to the proximal end 136 of the first arm 118 and distal to the head portion 92. In one exemplary embodiment, the proximal end 136 is disposed between the head portion 92 and the neck portion 94 of the loading funnel 88. The head portion 92 further defines the mouth 98 configured to readily receive organic smoking material, or any other desired material, into the loading funnel 88. In one aspect of the embodiment, the mouth 98 may have a discorectangle shape, as defined by the head portion 92. In one configuration, at least a portion of the loading funnel 88 may define a flat tapered surface 138. The flat tapered surface 138 may extend between the mouth 98 and the neck portion 94 of the loading funnel 88 and taper in diameter as it approaches the neck portion 94.

In another embodiment, the mouth 98 may have a rounded or straight edge defining a lip portion. The mouth 98 may also be defined in a variety of other shapes such as circular, rectangular, oval, square, or any other polygonal shape. In another embodiment, at least a portion of the loading funnel 88 may be configured to form a "dustpan-like" surface or any other surface having a sharpened straight edge to help facilitate the entry of organic smoking material, or any other desired material, into the loading funnel 88.

Figure 15:
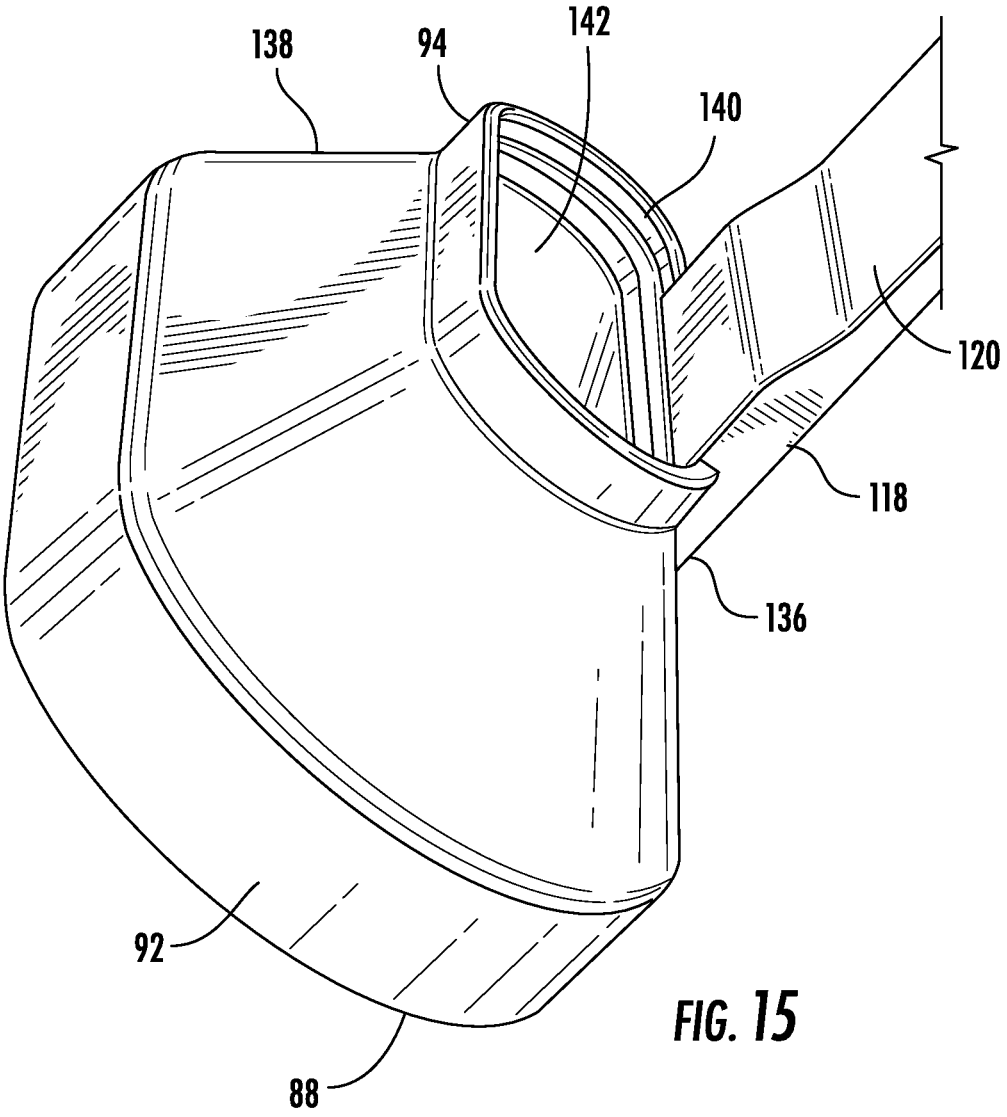
FIG. 15 shows a bottom perspective view of the loading funnel.

Referring now to FIGS. 15-16, the neck portion 94 includes an attachment element 140. The attachment element 140 may be used to removably attach the loading funnel 88 to at least a portion of the opening 116 of the container 30. In one embodiment, the attachment element 140 may be configured to directly engage the opening 116 of the container 30. This engagement may form a smooth sealed surface between the loading funnel 88 and the container 30. The formation of a seal being desirable as it lessens the chance that any organic smoking material is lost during the travel period from the loading funnel 88 into the container 30. In some exemplary embodiments, the seal formed may be "air-tight."

In one embodiment, the attachment element 140 may also be magnetic so that the loading funnel 88 may be magnetically attached to a corresponding magnetic element of a container or storage device. In another embodiment, the attachment element 140 may be configured to include a locking mechanism to secure the loading funnel 88 to the container 30.

In another embodiment, the neck portion 94 may be elastic, which facilitates the depositing of organic smoking material into the container 30. For example, the neck portion 94 may be expandable to allow larger pieces of the organic smoking material to travel through an aperture 142 into the container 30. The neck portion 94 may then conform back to its original configuration once the organic smoking material has completely passed through the neck portion 94.

Figure 17:
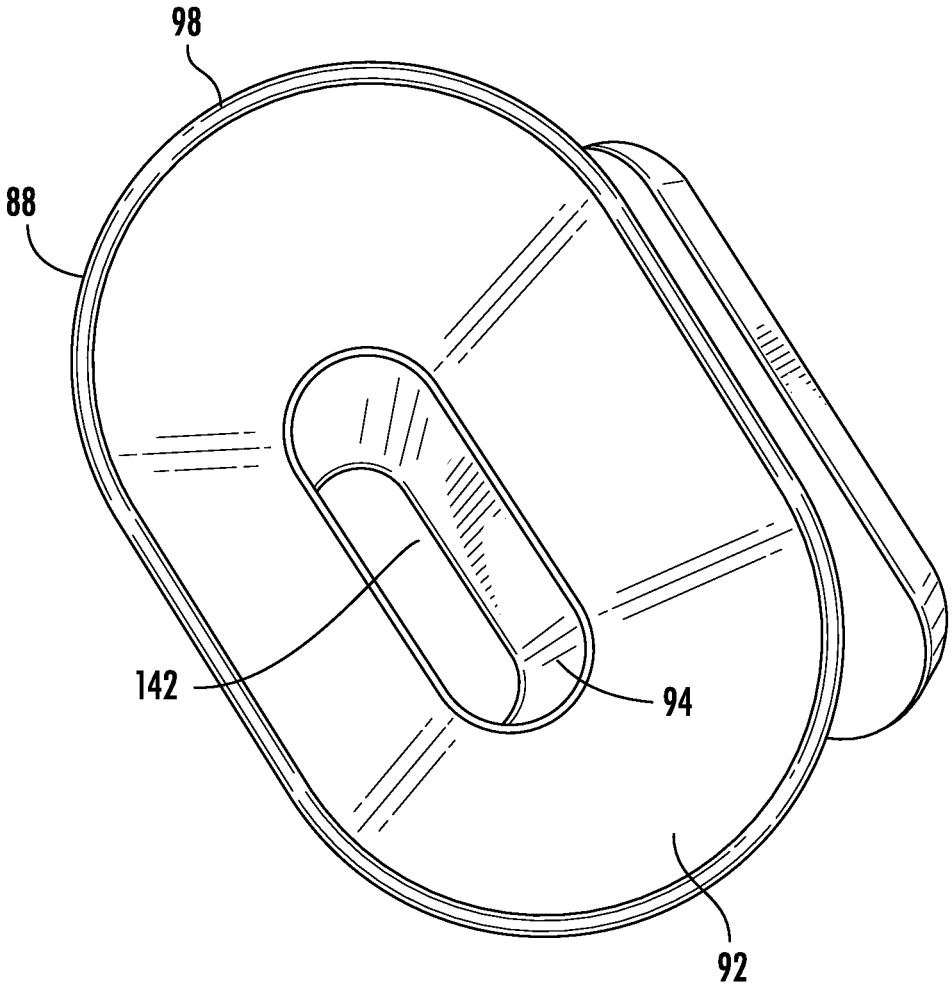
FIG. 17 shows a top view of the loading funnel of FIG. 15.

Referring now to FIG. 17, the neck portion 94 may be configured to allow a user to push organic smoking material from the head portion 92 through the aperture 142 and into the container 30 when the loading funnel 88 is attached to the container 30. In one configuration, the neck portion 94 is discorectangular and defines the aperture 142. However, in other configurations, the neck portion 94 may further define the aperture 142 in various other shapes including, but not limited to, circular, oval, rectangular, square, or any other shape that would allow for receipt of organic smoking material to pass through the aperture 142 from the loading funnel 88 into the container 30.

Figure 18:
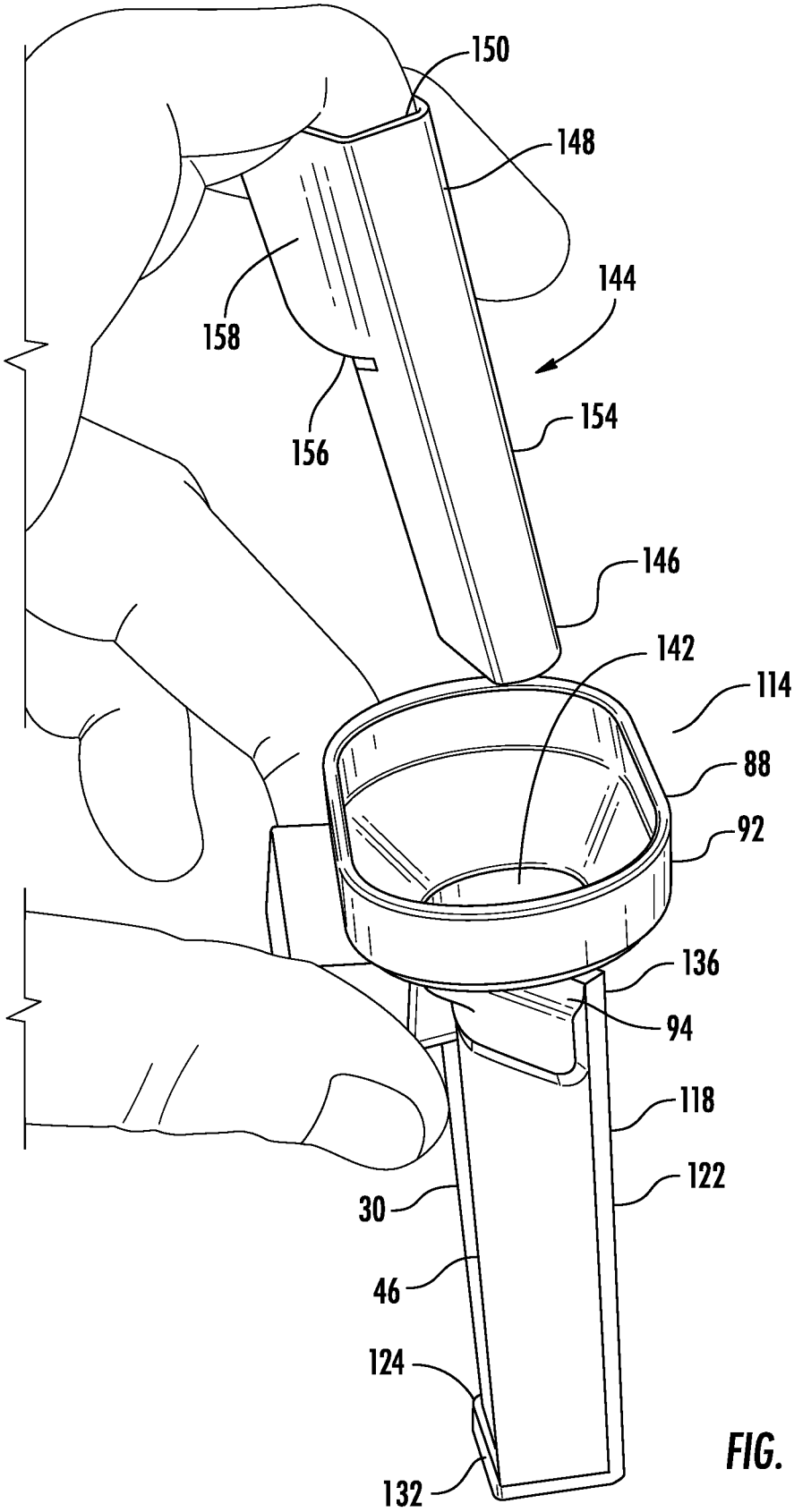
FIG. 18 shows a side view of the engagement of the pushing device and the loading device of FIG. 13.

Referring now to FIG. 18, the organic smoking material may be passed through the aperture 142 and into the container 30 by a pushing device 144. Additionally, the aperture 142 may be configured to receive at least a portion of the pushing device 144. In one configuration, the neck portion 94 is configured to at least partially receive a first portion 146 of the pushing device 144. The neck portion 94 may be configured to define the aperture 142 having the same shape as the surface of the first portion 146 of the pushing device 144. By having the same shape as the surface of the first portion 146, the aperture 142 can more readily receive the first portion 146 of the pushing device 144.

In one embodiment, the pushing device 144 may facilitate the depositing of the organic smoking material into the container 30 when the organic smoking material is first placed in the loading funnel 88 and the pushing device 144 is used to push the organic smoking material through the aperture 142, down the neck portion 94, and into the opening 116 of the container 30. In another embodiment, the aperture 142 may be sized to receive other pushing tools or devices, such as a rod or stick, for the insertion of the organic smoking material into the container 30.

Figure 19:
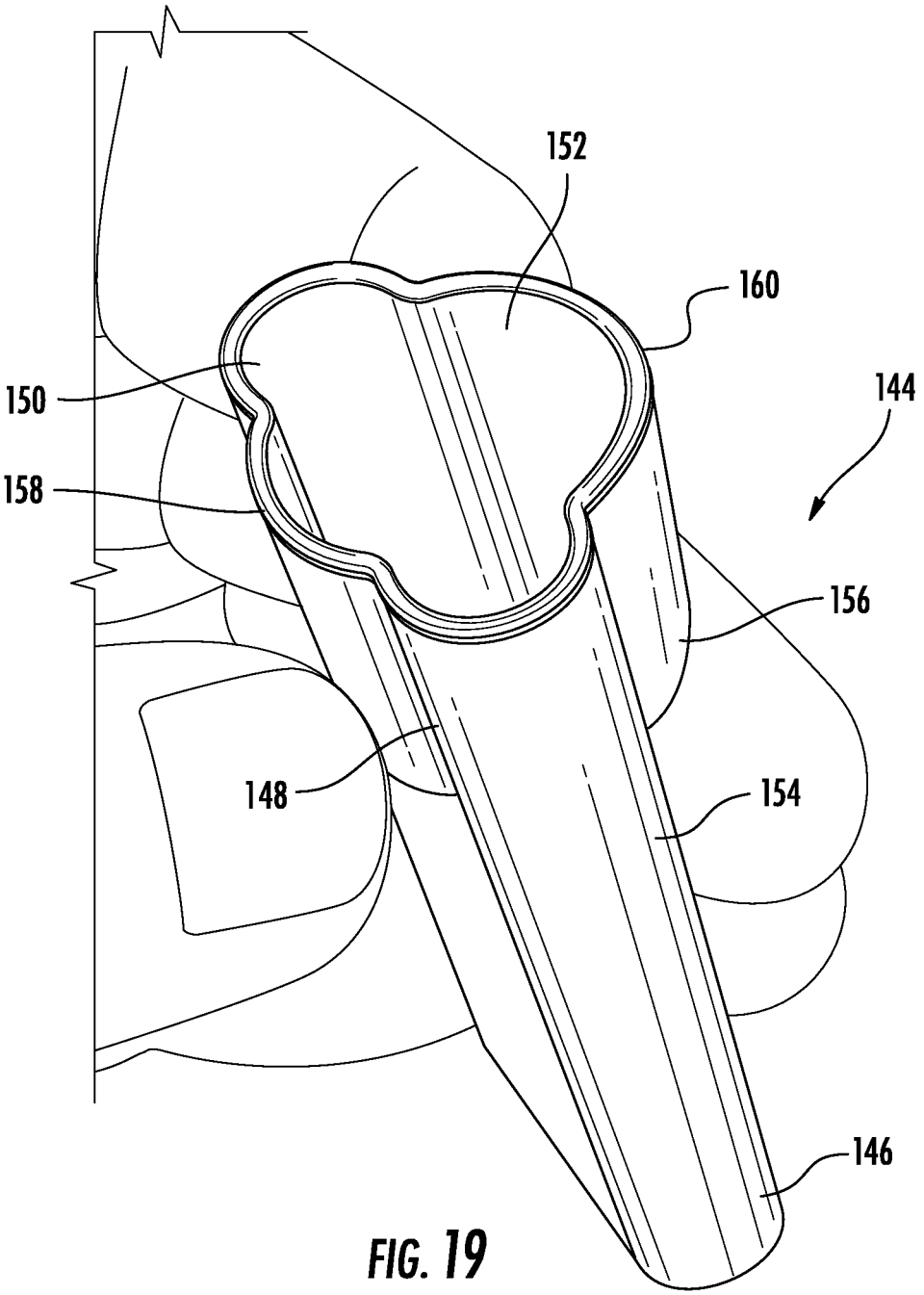
FIG. 19 shows a top perspective view of the pushing device of FIG. 18.
Figure 20:
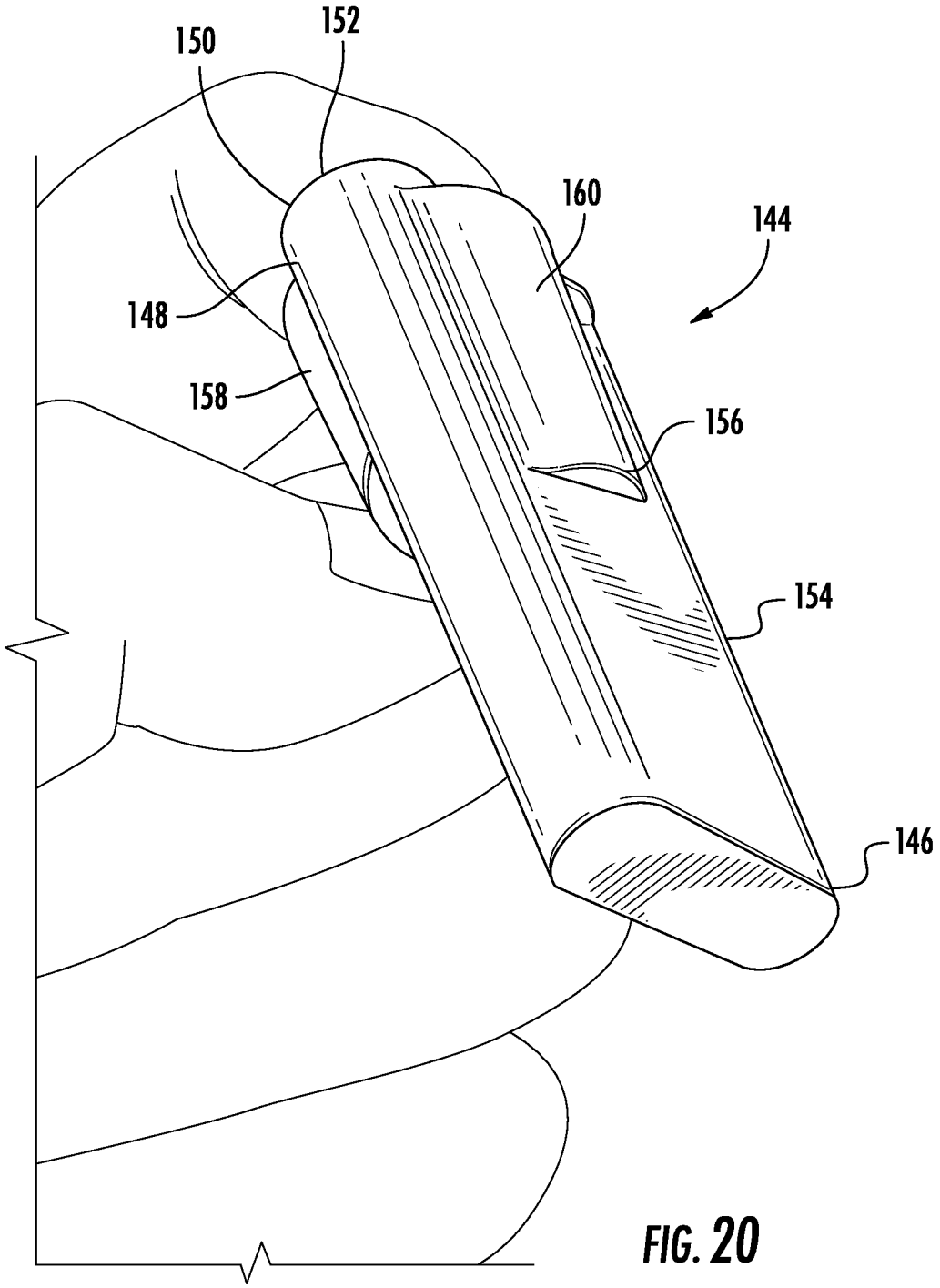
FIG. 20 shows a bottom perspective view of the pushing device of FIG. 18.

Referring now to FIGS. 19-20, in one embodiment, the pushing device 144 includes a second portion 148 defining a finger receiving element 150, sized and configured to receive at least a portion of a human finger. In one embodiment, the finger receiving element 150 defines an opening 152. The pushing device 144 includes the first portion 146, which is sized and configured to engage the aperture 142 of the loading funnel 88 and includes an elongated surface 154 extending between the second portion 148 and the first portion 146. The second portion 148 may also have a diameter larger than the first portion 146. Additionally, the pushing device 144 may include an interior closed wall or stopper element 156 distal to the opening 152 of the finger receiving element 150. In one embodiment, the interior closed wall or stopper element 156 is sized and configured to prevent the insertion of the human finger past a distance which is no more than half the length of the elongated surface 154. In another embodiment, the pushing device 144 may not include the stopper element 156, allowing more of a user's finger to be inserted into the pushing device 144.

In one embodiment, the opening 152 of the finger receiving element 150 further includes a first concave portion 158 configured to receive the human finger through the second portion 148 and a second arcuate portion 160 configured to receive at least a portion of the human finger to grasp the pushing device 144 when removing the pushing device 144 from the loading funnel 88. However, it will be understood that the pushing device 144 may have any suitable size, shape, or configuration that facilitates the insertion of a human finger or other insertable device or apparatus.

In one exemplary embodiment, the second portion 148 is sized and configured in such a way that when a human finger is inserted into the pushing device 144, a "suction-type" seal is formed between the finger and the pushing device 144 so that the pushing device remains connected to the finger during the "pushing" or facilitating of organic smoking material into the loading device 114.

In another embodiment, the first portion 146 of the pushing device 144 may define a flat, rounded, or pointed surface. In other exemplary embodiments, the first portion 144 may have a diameter equal to, smaller than, or larger than the second portion 148.

The first portion 146 of the pushing device 144 that is inserted into the aperture 142 of the loading funnel 88, may be configured such that the engagement of the first portion 146 and the neck 94 of the loading funnel 88 forms a seal therebetween.

In other exemplary embodiments, the loading device 114 may be configured to attach to other types of containers, grinders, bongs, pipes, or smoking devices in which organic smoking material may be deposited.

It will be appreciated by persons skilled in the art that the present embodiments are not limited to what has been particularly shown and described herein above. In addition, unless mention was made above to the contrary, it should be noted that all of the accompanying drawings are not to scale. A variety of modifications and variations are possible in light of the above teachings without departing from the scope of the following claims.

What is claimed is:

1. A loading device for a container for organic smoking material, the container having a first end defining an opening sized to receive the organic smoking material, an opposite second end, and a lateral surface extending therebetween, the loading device comprising:

a loading funnel sized and configured to engage at least a portion of the opening;

a first arm extending from the loading funnel and configured to be adjacent to the lateral surface when the loading funnel engages the opening; and a second arm extending from the first arm, the second arm being configured to releasably engage to the second end of the container when the first arm is adjacent to the lateral surface;

the second arm opposite and parallel with the loading funnel, wherein the second arm is orthogonal to the first arm, wherein the second arm has a proximal end, an opposite distal end, a first surface, and outer second surface, the second arm further including an engagement element, the engagement element being disposed on the distal end, wherein the engagement element is configured to removably attach the second arm to the container, wherein the first arm has a proximal end and an opposite distal end connected to the proximal end of the second arm, the first arm further including a first surface and an outer second surface, the second surface further including at least one groove extending laterally between a proximal end of the first arm and the distal end of the second arm, wherein the loading funnel is affixed to the proximal end of the first arm, wherein the loading funnel further includes a head portion distal to the proximal end of the first arm, wherein the loading funnel further includes a neck portion disposed between the head portion and the proximal end of the first arm, wherein the head portion further defines a mouth, wherein the neck portion defines an aperture having a shape selected from the group consisting of discorectangular, circular, and oval, wherein the aperture is sized to receive at least a portion of a pushing device, wherein the neck portion further includes an attachment element, the attachment element configured to removably attach the loading funnel to at least a portion of the opening of the container.

2. The device of claim 1, wherein at least a portion of the loading funnel defines a flat tapered surface.

3. The device of claim 2, wherein the flat tapered surface is extending between the mouth and the neck portion of the loading funnel.

* * * * *